US009351578B2

(12) United States Patent
Homans et al.

(10) Patent No.: US 9,351,578 B2
(45) **Date of Patent: *May 31, 2016**

(54) PORTABLE CHAIRS AND METHODS THEREOF

(71) Applicant: Alite Designs, Inc., San Francisco, CA (US)

(72) Inventors: Samuel B. Homans, Oakland, CA (US); Tae Wan Kim, San Francisco, CA (US); Kang S. Lim, San Ramon, CA (US)

(73) Assignee: Alite Designs, Inc., San Francisco, CA (US)

( * ) Notice: Subject to any disclaimer, the term of this patent is extended or adjusted under 35 U.S.C. 154(b) by 173 days.

This patent is subject to a terminal disclaimer.

(21) Appl. No.: 13/886,908

(22) Filed: May 3, 2013

(65) Prior Publication Data

US 2013/0313865 A1 Nov. 28, 2013

Related U.S. Application Data

(63) Continuation-in-part of application No. 13/794,824, filed on Mar. 12, 2013, and a continuation-in-part of application No. 13/662,402, filed on Oct. 26, 2012, which is a continuation of application No. 13/483,743, (Continued)

(51) Int. Cl.
*A47C 4/00* (2006.01)
*A47C 4/30* (2006.01)
(Continued)

(52) U.S. Cl.
CPC ... *A47C 4/30* (2013.01); *A47C 4/02* (2013.01); *A47C 4/28* (2013.01); *A47C 4/286* (2013.01)

(58) Field of Classification Search
CPC ..... A47C 4/42; A47C 4/286; A47C 4/30
USPC ..... 297/16.2, 45, 48, 56, 451.3, 440.11, 297/440.24, 16.1, 17.4, 452.13
See application file for complete search history.

(56) References Cited

U.S. PATENT DOCUMENTS 180,074 A * 7/1876 Skinner ..... 248/155.2
291,062 A 1/1884 Latour
(Continued)

FOREIGN PATENT DOCUMENTS

NL 1001847 6/1997

OTHER PUBLICATIONS

ISA/US, PCT International Search Report and Written Opinion, Application No. PCT/US2014/036715, Sep. 4, 2014, 12 pages.
(Continued)

*Primary Examiner* — Laurie K Cranmer
(74) *Attorney, Agent, or Firm* — Kang S. Lim

(57) ABSTRACT

A portable chair, configured to accommodate a seated user, includes a front pair of collapsible bars, a back pair of collapsible bars, a pair of joints, a center bar, a first set of lower bars, a second set of lower bars, and a sling. The center bar configured to securely couple the pair of back joints to each other. In some embodiments, at least one of the first set of lower bars has a first end permanently fixed to one of the joints, and a second end of first lower bars is configured to provide a point of contact with a ground surface. At least one of the second set of lower bars having a first end configured to be coupled to one of the joints, and wherein a second end of second lower bars is configured to provide a point of contact with a ground surface.

12 Claims, 32 Drawing Sheets

Related U.S. Application Data filed on May 30, 2012, now Pat. No. 8,646,835, which is a continuation-in-part of application No. 12/050,117, filed on Mar. 17, 2008, now Pat. No. 8,205,934.

(60) Provisional application No. 61/729,182, filed on Nov. 21, 2012.

(51) Int. Cl.
*A47C 4/02* (2006.01)
*A47C 4/28* (2006.01)

(56) References Cited

U.S. PATENT DOCUMENTS 2,099,345 A * 11/1937 Olszanowski ..... 297/4
2,257,831 A * 10/1941 Wood ..... 280/812
2,567,595 A * 9/1951 Bryant ..... 108/116
2,691,410 A * 10/1954 Boucher ..... 297/45
3,266,839 A * 8/1966 Combs ..... 297/57
3,312,437 A * 4/1967 Barth ..... 248/158
3,432,162 A * 3/1969 Flemming ..... 482/77
3,538,512 A * 11/1970 Dolan ..... 2/227
3,884,524 A * 5/1975 Eberle ..... 297/160
3,979,150 A * 9/1976 Elzenbeck ..... 297/410
4,095,842 A * 6/1978 Tretick ..... 297/4
4,101,163 A * 7/1978 Morin ..... 297/16.1
4,124,188 A 11/1978 Machen
4,148,520 A 4/1979 Miller
4,258,951 A 3/1981 Groom
4,494,796 A 1/1985 Liebhold
4,585,270 A 4/1986 Singer
4,605,261 A 8/1986 Lee
4,671,566 A * 6/1987 Knapp et al. ..... 297/16.2
4,673,211 A 6/1987 Hoffman
4,685,725 A * 8/1987 Helfrich ..... 297/45
4,807,930 A 2/1989 Helfrich
4,810,029 A * 3/1989 Kaladis et al. ..... 297/16.2
4,836,601 A 6/1989 Cone
4,892,352 A * 1/1990 Haywood ..... 297/195.11
4,930,839 A * 6/1990 Saito et al. ..... 297/338
5,054,849 A 10/1991 Hoff
5,362,130 A * 11/1994 Hoffman ..... 297/440.11
5,499,857 A 3/1996 Lynch, Jr.
5,709,428 A * 1/1998 Hugghins ..... 297/16.2
5,718,473 A 2/1998 Lynch, Jr.
5,921,621 A 7/1999 Cook et al.
5,927,797 A * 7/1999 Ferguson ..... 297/4
5,979,976 A * 11/1999 Ferencik ..... 297/16.1
5,988,750 A 11/1999 Rubottom
6,045,177 A * 4/2000 Grace ..... 297/45
6,062,638 A * 5/2000 Ferguson ..... 297/4
6,062,648 A * 5/2000 Adler ..... 297/440.24
6,089,593 A * 7/2000 Hanson et al. ..... 280/650
6,125,769 A * 10/2000 Tsai et al. ..... 108/34
6,485,095 B2 * 11/2002 Haubeil ..... 297/16.1
6,634,704 B1 10/2003 Bergquist
6,698,827 B2 3/2004 Le Gette et al.
6,796,605 B1 9/2004 Chu
6,820,927 B2 11/2004 Isom et al.
6,834,916 B2 * 12/2004 Volkman et al. ..... 297/270.1
6,871,905 B2 3/2005 Grace
6,893,097 B1 * 5/2005 Ebensperger et al. ..... 297/451.4
6,926,355 B2 * 8/2005 Le Gette et al. ..... 297/16.2
7,044,267 B2 * 5/2006 Sigler ..... 182/15
7,137,351 B2 11/2006 Picou
7,198,324 B2 * 4/2007 Le Gette et al. ..... 297/16.2
7,240,961 B2 7/2007 Grace
7,328,940 B2 * 2/2008 Zheng et al. ..... 297/44
D565,332 S * 4/2008 Erickson ..... D6/501
7,374,237 B2 5/2008 Park et al.
7,384,097 B2 * 6/2008 Park et al. ..... 297/45
7,469,961 B2 * 12/2008 Liu ..... 297/16.1
7,681,267 B1 * 3/2010 Hall ..... 5/655
8,454,084 B2 * 6/2013 Lah ..... 297/16.2
8,646,835 B2 2/2014 Homans et al.
2003/0222484 A1 12/2003 Gette et al.
2004/0232740 A1 11/2004 Enge
2005/0285436 A1 12/2005 Le Gette et al.
2006/0061146 A1 3/2006 Grace
2006/0071512 A1 4/2006 Saakyan
2007/0252416 A1 11/2007 Park et al.
2009/0230736 A1 9/2009 Homans
2010/0212087 A1 * 8/2010 Leib et al. ..... 5/81.1 R
2012/0104805 A1 5/2012 Lah
2012/0326470 A1 12/2012 Homans et al.
2013/0069397 A1 3/2013 Homans et al.

OTHER PUBLICATIONS

ISA/KR, PCT International Search Report and Written Opinion, Application No. PCT/US2013/035153, dated Aug. 5, 2013, 12 pages.
ISA/KR, PCT International Search Report and Written Opinion, Application No. PCT/US2013/071090, Apr. 8, 2014, 10 pages.

* cited by examiner

PORTABLE CHAIRS AND METHODS THEREOF

CROSS REFERENCE TO RELATED APPLICATIONS

This is a continuation-in-part and claims benefit of U.S. application Ser. No. 13/794,824 filed on Mar. 12, 2013, entitled "Portable Chairs and Methods Thereof", which is a non-provisional of U.S. Provisional Application No. 61/729,182 filed on Nov. 21, 2012, of same title, both applications are hereby fully incorporated by reference.

This continuation-in-part application also claims benefit of U.S. application Ser. No. 13/662,402 filed on Oct. 26, 2012, entitled "Portable Chair", which is a continuation of U.S. application Ser. No. 13/483,743 filed on May 30, 2012, entitled "Systems and Methods for Portable Furniture", which is a continuation-in-part of U.S. application Ser. No. 12/050,117 filed on Mar. 17, 2008 entitled "Portable Chair", now U.S. Pat. No. 8,205,934, issued Jun. 26, 2012, which applications/patents are fully incorporated herein in their entirety by this reference.

BACKGROUND

The present invention relates to systems and methods for portable furniture. In particular, the invention relates to portable, lightweight and collapsible stable chairs well suited for camping and travelling.

Conventional portable chairs are not truly portable for outdoor use and cannot accommodate sitting on a hillside or uneven terrain. An example of one such portable chair is a "stadium seat" which consists of two flat pads with a hinge in the middle, rigid posts along their outer lateral edges and adjustable straps that run on each side of the pads from the top corner to the bottom corner. In a stadium seat, when a user leans back, the sides of the pads and posts are pulled in towards the body along with the straps, and generally, the heavier the user is, the more uncomfortable the stadium seat is. Further, the user cannot use this chair to sit comfortably on a hillside or on uneven terrain.

Thus, there is a need in the chair field to create new, useful, portable, stable and comfortable chairs. These improved portable chairs are strong, lightweight and collapsible, and are well suited for use on uneven terrain often encountered outdoors.

SUMMARY

To achieve the foregoing and in accordance with the present invention, systems and methods for constructing portable furniture is provided. In particular, the invention provides portable, lightweight and collapsible stable chairs well suited for camping and travelling.

In one embodiment, a portable chair, configured to accommodate a seated user, includes a front pair of collapsible bars, a back pair of collapsible bars, a pair of joints, a center bar, a first set of lower bars, a second set of lower bars, and a sling. Each of the front pair and the back pair of collapsible bars has a first end and a second end. Each of the pair of joints is configured to be coupled to the corresponding first end of each of the front pair of collapsible bars and also to be coupled to the corresponding first end of the back pair of collapsible bars. The center bar configured to securely couple the pair of back joints to each other.

In some embodiments, at least one of the first set of lower bars has a first end permanently fixed to one of the joints, and a second end of first lower bars is configured to provide a point of contact with a ground surface. At least one of the second set of lower bars having a first end configured to be detachably coupled to one of the joints, and wherein a second end of second lower bars is configured to provide a point of contact with a ground surface.

Note that the various features of the present invention described above may be practiced alone or in combination. These and other features of the present invention will be described in more detail below in the detailed description of the invention and in conjunction with the following figures.

BRIEF DESCRIPTION OF THE DRAWINGS

In order that the present invention may be more clearly ascertained, some embodiments will now be described, by way of example, with reference to the accompanying drawings, in which:

FIGS. 35A-35D illustrate additional configurations of portable chair frames while

DETAILED DESCRIPTION

The present invention will now be described in detail with reference to several embodiments thereof as illustrated in the accompanying drawings. In the following description, numerous specific details are set forth in order to provide a thorough understanding of embodiments of the present invention. It will be apparent, however, to one skilled in the art, that embodiments may be practiced without some or all of these specific details. In other instances, well known process steps and/or structures have not been described in detail in order to not unnecessarily obscure the present invention. The features and advantages of embodiments may be better understood with reference to the drawings and discussions that follow.

The present invention relates to systems and methods for constructing portable, lightweight and collapsible stable chairs well suited for camping and travelling. To facilitate discussion, FIGS. 1-24 illustrate several embodiments of portable chairs in accordance to the present invention.

Figure 1:
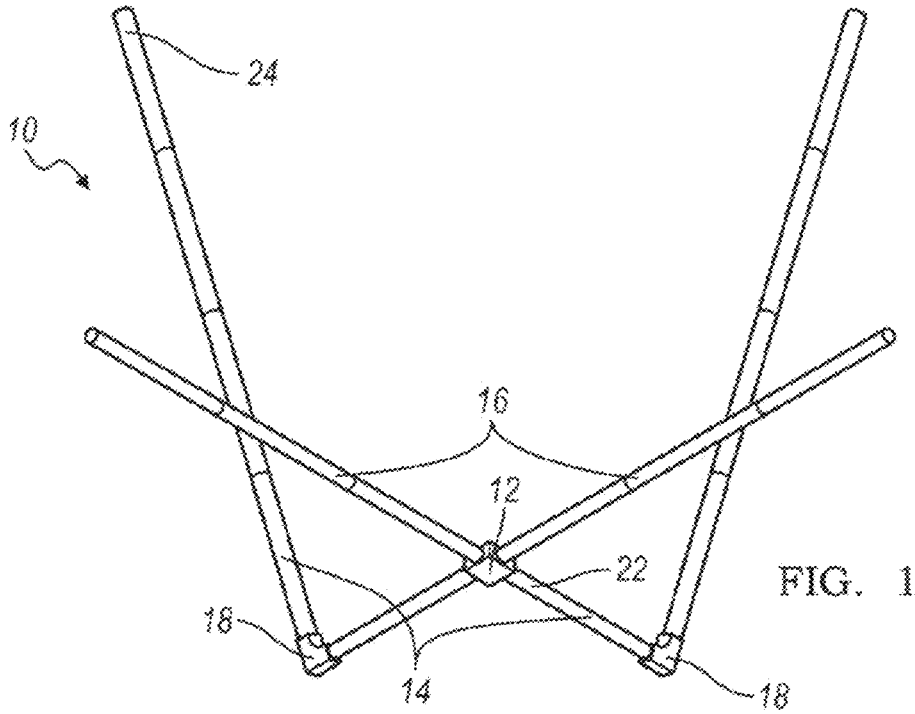
FIG. 1 is a perspective view of one embodiment of a portable chair frame in accordance with the present invention.
Figure 2:
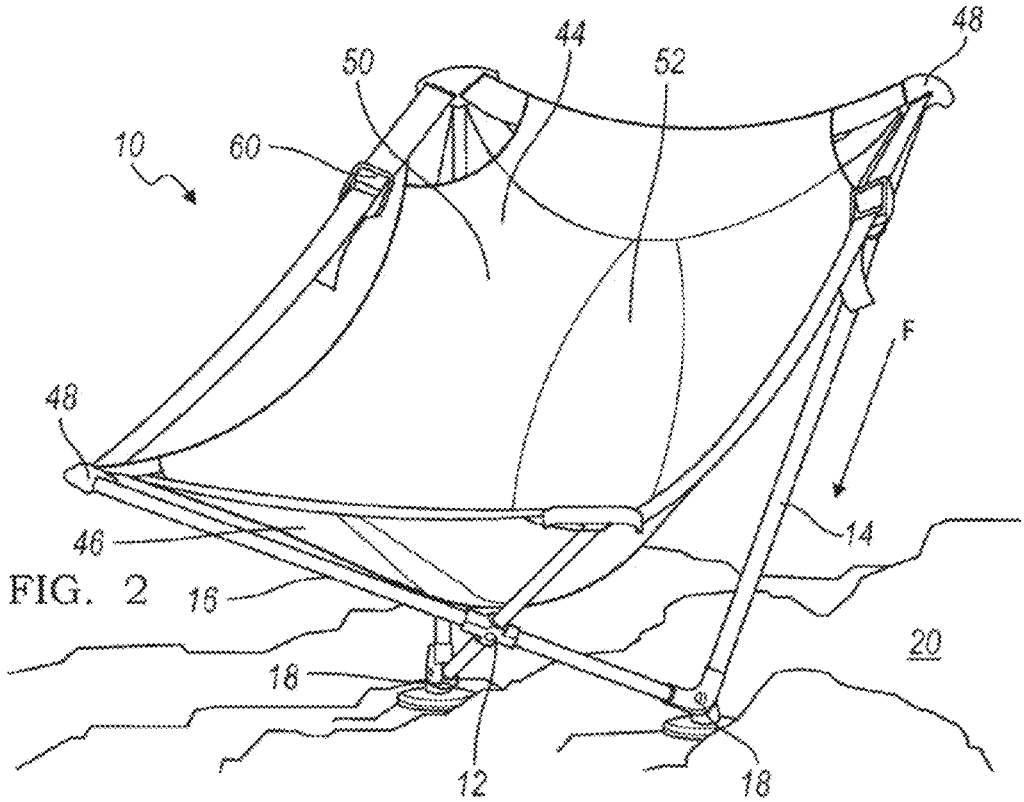
FIG. 2 illustrates the portable chair frame supporting a sling of the embodiment of FIG. 1.

As shown in FIGS. 1 and 2, the portable chair frame 10 that supports a sling of the described embodiments includes a first pair of collapsible bars 14, a second pair of collapsible bars 16, and two joints 18 that each provide a point of contact with a ground surface 20. Each collapsible bar has a first end 22 coupled to the other first ends 22 and a second end 24 that provides a sling interface for the sling. The joints 18 are included in each of the collapsible bars of the first pair of collapsible bars 14. The portable chair frame 10 further includes a brace coupled to the first ends 22 of the collapsible bars. The portable chair frame 10 is configured to support a sling and, more specifically, a portable chair frame that supports a sling designed for use on uneven terrain. In use, a user can sit in the sling supported by the portable chair frame 10. The portable chair frame 10 provides two points of contact with a ground surface 20, and the user provides a third point of contact with the ground surface 20 with their feet or legs. The joints 18 prevent rotation of the chair about a single axis (i.e., preventing the chair from rotating from side to side, while allowing the chair to rock back and forth), while the user uses their legs and/or feet to stabilize the chair about a second axis (i.e., controlled rocking back and forth or preventing it all together). The portable chair frame 10 that supports a sling, however, may be alternatively used in any suitable environment and for any suitable reason.

I. A Portable Chair Frame Embodiment

In this embodiment, the brace 12 functions to couple the first pair of collapsible bars 14 to the second pair of collapsible bars 16 and to hold the joints 18 a first distance from one another and to hold the second ends 24, which provide the sling interface, a second distance from one another. The first distance of the joints 18 can be less than the second distance of the second ends 24 such that the first pair of collapsible bars that each can run from two second ends 24 to the two joints 18 (the points of contact with a ground surface) are substantially parallel or inline with a generated force vector F, as shown in FIG. 2. The force vector is generated when a user sits in the sling, and their weight, supported by the sling, is transferred to the frame. The sling "pulls" on the frame, generating a force vector F in the direction shown. Due to the fact that the first collapsible bars are substantially parallel or inline with the generated force vector F, they are optimally positioned to support the force and are less likely to buckle, or fail in any other fashion.

Figure 5:
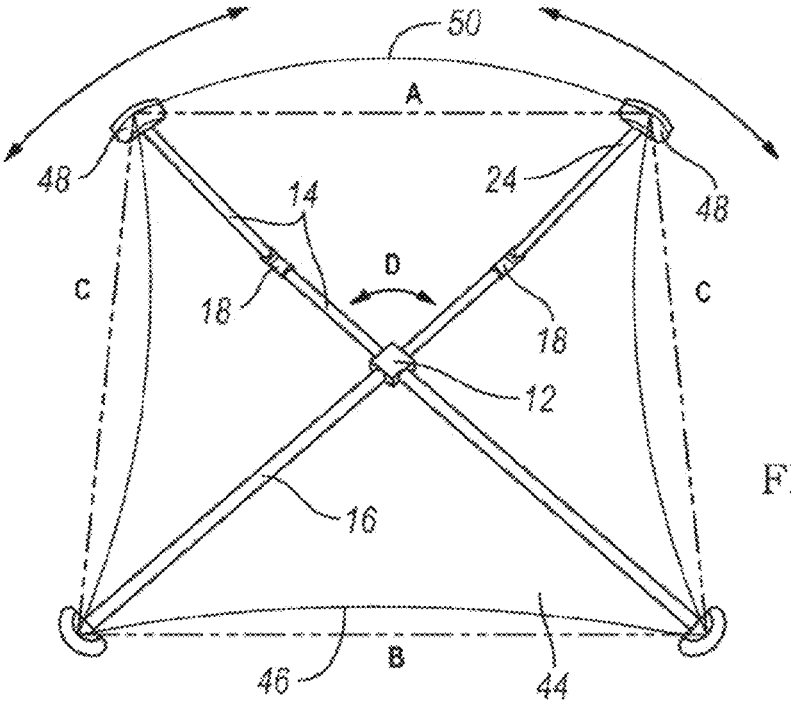
FIG. 5 shows the portable chair frame for the embodiment of FIG. 1.

Additionally as shown in FIG. 5, the brace 12 holds the first ends of the first pair of bars 14 at a positive angle D less than 180 degrees (approximately 70 to 110 degrees) which constrains the joints to rotate around the axes at angle D to one another. Therefore, the joints themselves are rigid and the sling interfaces 48 at the second ends 24 of the first bars 14 rotate in planes at angle D to one another. The sling interfaces 48 are also constrained in their movement by the sling itself. The upper portion 50 of the sling links together the sling interfaces at the second ends 24 of the first pair of collapsible bars such that the distance A between them cannot increase. The second pair of bars 16 are fixed in space so that their second ends 24 are at a fixed distance B from one another. This distance B can be greater than distance A. For the distance A to decrease, the distances C along the lateral edges of the sling would have to increase. Therefore the sling is held open when unoccupied. By the same token, when a user is seated in the sling, while the users weight exerts a force on the sling that tends to pull the upper sling interfaces together, the force is resisted by the lateral edge of the sling and especially by the adjustment element 60 which are both connected to the fixed second ends of the second bars.

Additionally, the brace couples the first pair of collapsible bars 14 to the second pair of collapsible bars 16 such that the lines of the bars cross at the brace. This arrangement helps the frame push the second ends 24 that provide a sling interface away from one another rather than towards one another due to the weight of the user. The brace 12 is located close to the sling such that is minimizes the bending forces of the bars, and such that it is above the ground surface to allow the joints 18 to contact an uneven ground surface. The uneven ground surface is able to cross through the line and/or break the plane created by the two points of contact of the joints 18, as shown in FIG. 2, such that the ground surface can be sand, rock, hillside, or any other suitable uneven terrain.

Figure 3A:
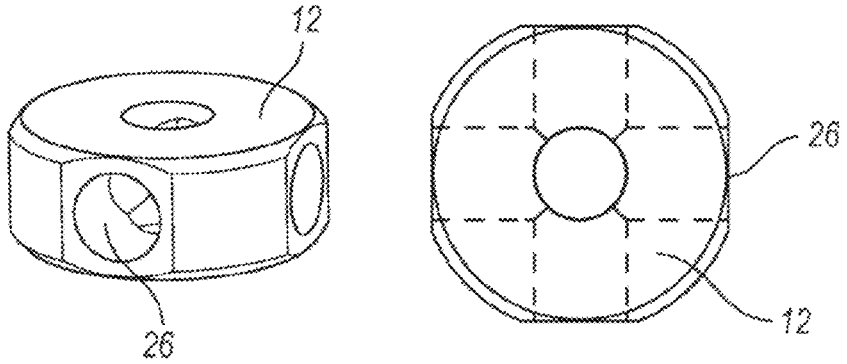
FIG. 3A is a side view and a top view of the brace for the embodiment of FIG. 1.
Figure 3B:
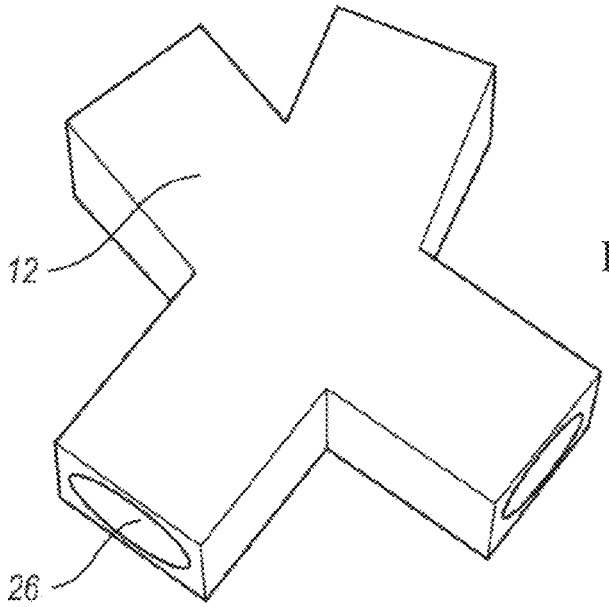
FIG. 3B is a perspective view of an alternate brace for the embodiment of FIG. 1.
Figure 4:
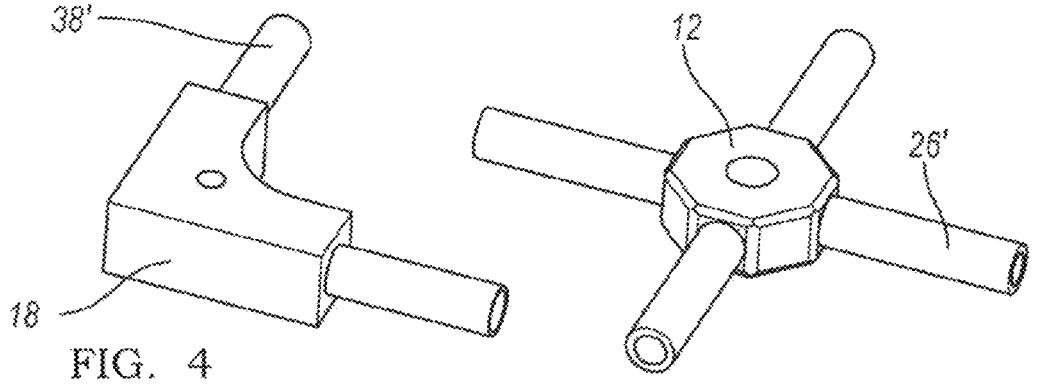
FIG. 4 illustrates the brace and the joint for the embodiment of FIG. 1.

The brace 12 is one of several variations. As shown in FIGS. 3A and 4, a first variation of the brace 12 includes four receiving elements 26. The receiving elements each receive a portion of a collapsible bar such that the brace and the collapsible bars inserted into the receiving elements are in substantially the same plane. The brace and the receiving elements restrict movement of the collapsible bars in at least one direction. The collapsible bars may pivot or rotate with respect to the brace, such that they may fold up over or with the brace. Alternatively, the collapsible bars may be fixed by the brace. As shown in FIG. 3A, the receiving elements position the collapsible bars inserted into the receiving elements at substantially right angles to one another, but may alternatively position the collapsible bars inserted into the receiving elements at any suitable angle to one another, including a combination of different angles, as shown in FIG. 3B. The brace 12 may have any suitable geometry to define the four receiving elements 26, such as a cross shape as shown in FIG. 3B. In a first version of the first variation, as shown in FIG. 3A, the brace 12 is cylindrical and defines a cavity that receives a portion of a collapsible bar. The cavity can be cylindrically shaped, but may alternatively have any suitable shape such that it receives a portion of a collapsible bar.

In a second version of the first variation, as shown in FIG. 4, the brace 12 is cylindrical and defines a center hole to reduce the mass of the brace 12 and functions to receive a portion of a collapsible bar around the outer diameter of the cylindrical receiving element or inside the inner diameter of the cylindrical receiving element. The receiving elements are coupled such that a cord or a portion of a collapsible bar may run from one receiving element to another receiving element. Although the brace 12 and the receiving elements 26 can be one of these two versions of the first variation, the brace 12 and the receiving elements 26 may be any suitable element to couple the first pair of collapsible bars 14 to the second pair of collapsible bars 16 and to hold the joints 18 a first distance from one another.

Although the brace 12 can be one of these several variations, the brace may alternatively be any suitable mechanism to couple the first pair of collapsible bars 14 to the second pair of collapsible bars 16 and to hold the joints 18 a first distance from one another and hold the second ends 24, which provide the sling interface, a second distance from one another.

The bars of the described embodiments function to support the sling and the weight of a user. The bars can be one of several variations. As shown in FIG. 2, the bars (the first pair of bars 14 and the second pair of bars 16) are cylindrical rods, but may alternatively have any suitable geometry and may have varying geometries along the length of the rods. The bars are straight or linear bars, but may alternatively be curved, bent, or have any other suitable geometry. The bars can be made of metal (such as 0.433" 7075 T9 aluminum poles with a 0.030" wall thickness), or plastic, but may be alternatively made from any suitable material. The bars 14 and 16 are collapsible or foldable such that they include multiple sections that can be assembled to support the sling and the weight of the user and can be disassembled for easy transportation and storage. Each of the sections are straight, but may alternatively be curved or angled. Each section may have the same radius of curvature or angle, but alternatively each section may have a different radius of curvature or angle.

Figure 6:
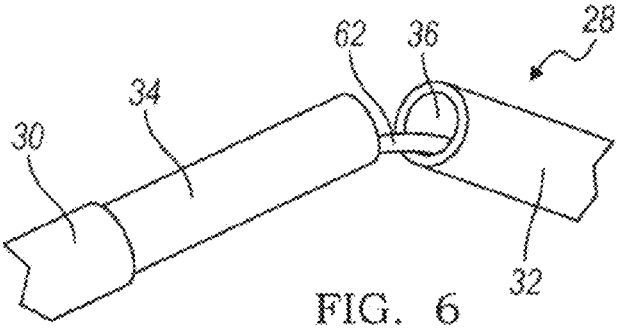
FIG. 6 shows the first bar section and the second bar section for the embodiment of FIG. 1.

As shown in FIG. 6, the collapsible bar 28 includes a first bar section 30 and a second bar section 32 removably coupled to a first bar section 30. The first bar section 30 has an end portion with an outer diameter dimension 34 and the second bar section 32 has an end portion that defines a recess 36 that receives the outer diameter dimension 34 of the end portion of the first bar section 30. The outer diameter dimension 34 has a diameter less than the outer diameter of the collapsible bar. For example, they may have 0.370" outer diameter while the collapsible bars have an outer diameter of 0.433". The end portion of the first bar section 30 may be a separate piece that is coupled to the first bar section 30. For example, the separate piece may have an outer diameter of 0.433" with a 0.040" wall thickness. Alternatively, the first bar section may couple to the second bar section in any other suitable fashion. The first bar section 30 is substantially identical to the second bar section 32, but alternatively, the first bar section 30 and the second bar section 32 may have different geometries, dimensions, and/or cross sections. Each collapsible bar can include any suitable number of bar sections. In a first variation, as shown in FIG. 2, the first pair of collapsible bars 14 and the second pair of collapsible bars 16 each include multiple bar sections. The joint 18 of the first pair of collapsible bars 14 couples one bar section to multiple bar sections at a substantially right angle. The joint 18 may alternatively couple any suitable combination of bar sections at any suitable angle to one another.

Figure 7:
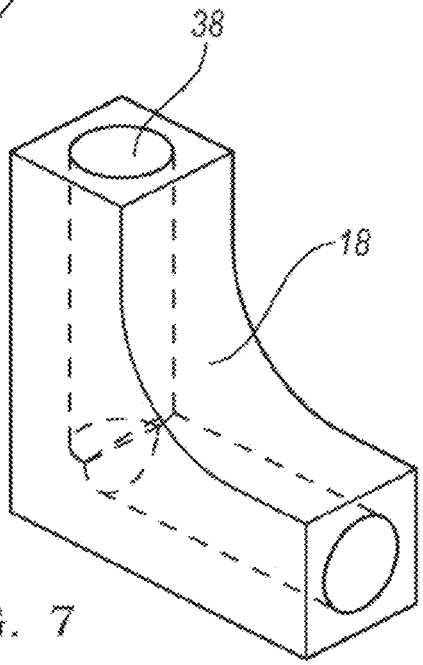
FIG. 7 is a perspective view of the joint for the embodiment of FIG. 1.

The joints 18 of the described embodiments function to provide a point of contact with a ground surface 20. The joints 18 can be one of several variations. In a first variation, as shown in FIG. 7, the joints 18 define two receiving elements 38. The receiving elements each receive a portion of a collapsible bar such that the joint and the bars inserted into the receiving elements are in substantially the same plane. As shown in FIG. 7, the receiving elements position the bars inserted into the receiving elements at substantially a right angle to one another, but may alternatively position the bars inserted into the receiving elements at any suitable angle to one another. The joint 18 may have any suitable geometry to define the two receiving elements 38. In a first variation, as shown in FIG. 7, the joint 18 is L-shaped and the receiving element can be a cavity that receives a portion of a collapsible bar. The L-shaped joint has a pointed vertex, but may alternatively have a curved or flat vertex. The cavity is cylindrically shaped, but may alternatively have any suitable shape such that it receives a portion of a collapsible bar.

In a second variation, as shown in FIG. 4, the receiving element 38' is a cylindrical receiving element that functions to receive a portion of a collapsible bar around the outer diameter of the cylindrical receiving element or inside the inner diameter of the cylindrical receiving element. The receiving elements are coupled such that a cord or a portion of a collapsible bar may run from one receiving element to another receiving element. In an alternative variation, the joint 18 may be formed by bending a portion of a bar and the bar may be curved or bent to form the joint 18. The joint 18 can be made of metal (such as aluminum) or plastic, but may be alternatively made from any suitable material. Although the joint 18 and the receiving elements 38 can be one of these variations, the joint 18 and the receiving elements 38 may be any suitable element to support the sling and the weight of a user.

Figure 8:
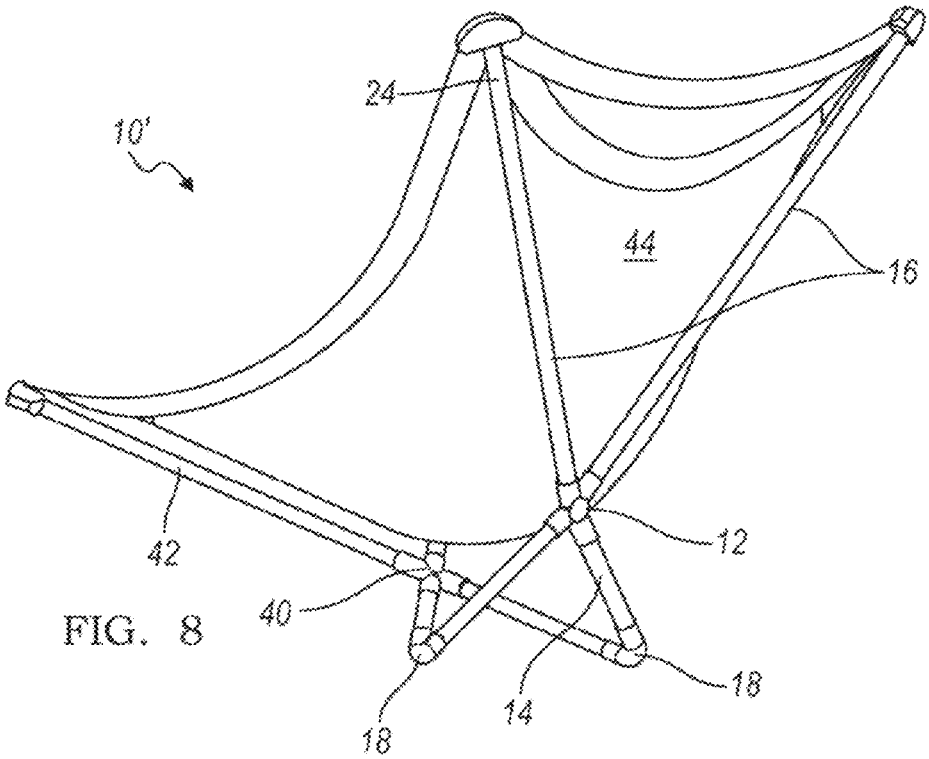
FIG. 8 shows the portable chair frame supporting a sling of an alternate embodiment of the present invention.

As shown in FIG. 8, the portable chair frame 10' of the second embodiment is nearly identical to the portable chair frame 10 of the first embodiment. The difference between the two embodiments, however, is that the portable chair frame 10' of the second embodiment further includes a second brace 40 and a third pair of collapsible bars 42. In this embodiment, the first pair of collapsible bars 14, including the joints 18, have a first end coupled to the first brace 12 and a second end coupled to the second brace 40 and the third pair of collapsible bars 42 each have a first end coupled to the second brace 40 and a second end 24 that provides a sling interface.

II. A Sling (Seat) Embodiment

The portable chair frame 10 of the described embodiments also includes a sling 44, which is supported by the portable chair frame 10 and supports the weight of a user. As shown in FIG. 2, the sling 44 includes a seat bottom portion 46 with frame interface elements 48 and a seat back portion 50 with frame interface elements 48. The frame interface elements 48 are coupled to the four sling interfaces of the collapsible bars. The four frame elements are coupled to the sling and removably coupled to the portable chair frame, but may alternatively be removably coupled to the sling and coupled to the portable chair frame, removably coupled to both, or coupled to both. In a first variation, as shown in FIG. 2, the frame interface elements 48 of the seat back portion 50 couple to the first pair of collapsible bars 14 and the frame interface elements 48 of the seat bottom portion 46 couple to a second pair of collapsible bars 16 such that the brace 12 is substantially adjacent or below the seat bottom portion 46 of the sling.

Figure 9:
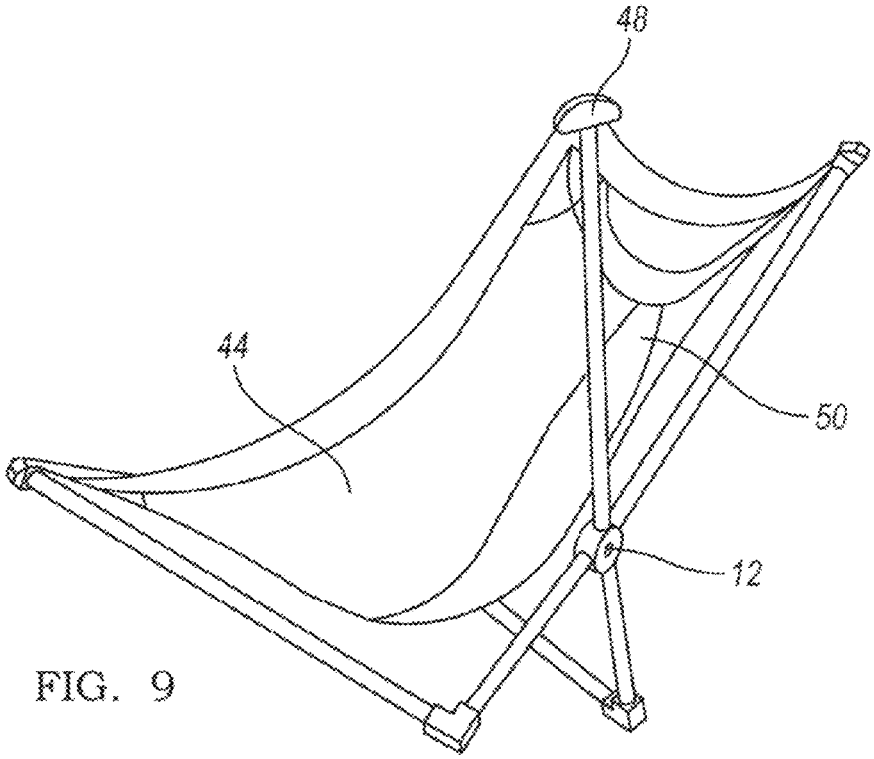
FIG. 9 shows the portable chair frame supporting a sling of the embodiment of FIG. 1.

In a second variation, as shown in FIG. 9, the frame interface elements 48 of the seat back portion 50 couple to the second pair of collapsible bars 16 and the frame interface elements 48 of the seat bottom portion 46 couple to the first pair of collapsible bars 14 such that the brace 12 is substantially adjacent or behind the seat back portion 50 of the sling. The sling can be made of a durable and/or waterproof material such as fabric, vinyl, or plastic, but may alternatively be made out of any suitable material.

The sling 44 of the described embodiments also includes a shaping element that functions to provide a "bucket" shape to the sling 44, which prevents the user from sliding forward out of the seat, especially when their feet are not firmly planted. The shaping element can also functions to allow the sides of the sling 44 to better contain the users' hips and to provide better back support. The shaping element can be one of several variations. In a first variation, the shaping element is a gusset 52, as shown in FIG. 2, which runs from the seat bottom portion to the seat back portion. The gusset 52 can be diamond or lozenge shaped, but may alternatively have any other suitable geometry. In a second variation, the shaping element includes darts in the seat bottom portion of the sling. The darts may alternatively be located near the edges of the sling, but may alternatively be in any suitable portion of the sling to provide a "bucket" shape to the sling 44. In a third variation, the shaping element is a panel or portion of the sling made out of a stretchable fabric, such that the sling can expand to provide a "bucket" shape to the sling 44 when the user sits into the portable chair. The shaping element may alternatively be any other suitable shaping element that functions to provide a "bucket" shape to the sling 44 and allow the sides of the sling 44 to better contain the users' hips.

Figure 10:
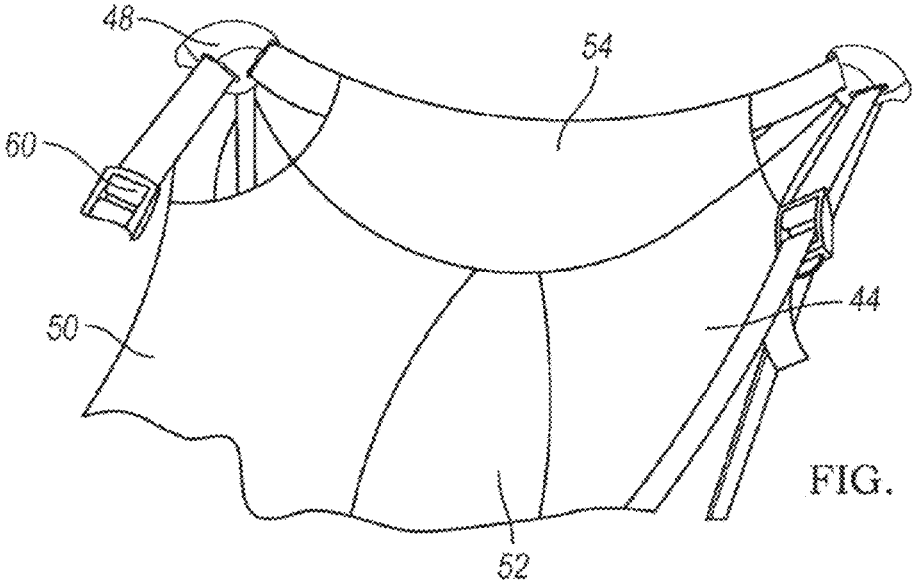
FIG. 10 illustrates the sling for the embodiment of FIG. 1.

The sling 44 of the described embodiments also includes a weight distribution element that functions to reduce the pressure of the sling 44 against the back of the user. The weight distribution element can be one of several variations. In a first variation, the weight distribution element is a panel 54, as shown in FIG. 10, in the seat back portion 50 of the sling that couples the two frame interface elements 48 to one another. The panel 54 can be semi-circular or crescent shaped such that when the weight of the user is applied to the sling, the top portion supports a first amount of weight and the bottom rounded portion supports a second amount of weight. The second amount of weight is larger than the first amount due to the orientation of the bottom rounded portion with respect to the frame of the chair. The top portion is substantially perpendicular to the collapsible bar coupled to the seat back portion of the sling, and the bottom rounded portion, where it couples to the frame, is substantially parallel or inline with the collapsible bar such that the majority of the weight supported by the sling is supported by the bottom rounded portion rather than the top portion. The second amount of weight is larger than the first amount of weight to reduce the tension on the upper sling edge 55 and reduce its pressure against the back of the user. The weight distribution element may alternatively be any other suitable variation to reduce the pressure of the upper sling edge 55 against the back of the user.

In one variation, as shown in FIG. 2, the sling 44 includes multiple panels. The panel 54 at the top portion of the seat back portion 50 of the sling 44 has a semicircle shape and is positioned in the sling 44 such that the curved portion is lower than the straight portion. The three remaining panels radiate from curved portion of panel 54. One of those three panels is the gusset 52. The gusset 52 runs from the panel 54 to the bottom of the sling. Mirrored around the gusset 52 are two rectangular panels. The two outside panels are substantially flat (i.e. not bucket shaped), but may alternatively include darts or any other suitable shaping element. The two outside panels may alternatively each be replaced by a two triangular panels, or may alternatively include any other suitable number of panels. The two triangular panels are substantially "30-60-90" triangles with the 90 degree angles adjacent to the gusset 52 at the bottom of the sling. On the outside of those two panels, are two more similarly shaped panels with the 90 degree angles located at the far outside, top corners of the sling. The two outside panels (each including two triangular panels) on each side of the gusset 52 form a rectangle on either side of the gusset 52.

Figure 11A:
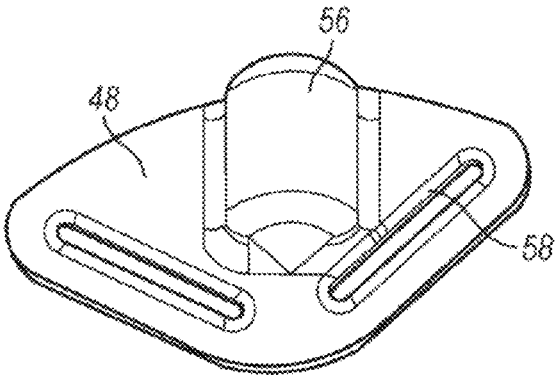
FIGS. 11A and 11B are front and back views respectively of the frame interface element for the embodiment of FIG. 1.
Figure 11B:
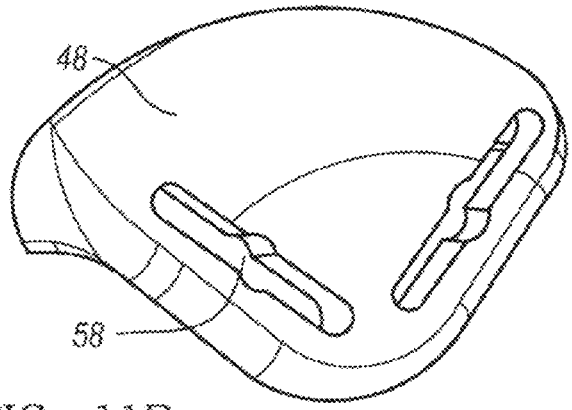

The frame interface elements 48 of the described embodiment function to couple the sling 44 to the portable chair frame 10. In a first variation, as shown in FIGS. 11A and 11B, the frame interface elements 48 each define a receiving element 56 that receives a portion of a collapsible bar and define a slot 58 that receives a portion of the sling 44. The frame interface element 48 defines the receiving element 56 such that it holds the portion of the collapsible bar at a predetermined angle relative to the sling 44 and to the other collapsible bars. The frame interface element 48 has a triangular geometry with two slots 58. The slots are about one inch wide and located on the triangular face approximately 100 degrees from each other. A portion of the sling (i.e. a strap coupled to the sling 44) is coupled to each of the slots of the frame interface element 48. In this variation, there is a left and right handed version of the frame interface element 48 such that the left handed and the right handed version each hold the portion of the collapsible bar at a predetermined angle (depending on the left or right side of the sling) relative to the sling 44 and to the other collapsible bars. The frame interface element 48 of this variation has a rounded edge along the top portion of the frame interface element 48 to prevent pressure or discomfort to the user. The frame interface elements can be made from metal, plastic, polycarbonate, or any other suitable material.

The frame interface elements may be machined, injection molded, or manufactured in any other suitable fashion. In a second variation, frame interface elements 48 are grommets or washers coupled to or sewn into the sling 44 that slide over or otherwise couple to the second ends 24 of the collapsible bars. In a third variation, the frame interface elements 48 are pockets that are coupled to or sewn into the sling 44 that slide over or otherwise couple to the second ends 24 of the collapsible bars.

The sling 44 of the described embodiments can also includes an adjustment element 60, as shown in FIGS. 2 and 10, that couples the seat bottom portion 46 to the seat back portion 50 and the length of the adjustment element 60 may be lengthened or shortened to increase or decrease the distance and the angle between the seat bottom portion 46 and the seat back portion 50. The sling 44 may further include straps coupled to the frame interface element 48 that run along the slide of the sling 44. The adjustment elements 60 are coupled to these straps and function to lengthen and shorten the lengths of these straps. The adjustment element 60 can be a ladder-lock buckle, but may alternatively be any suitable adjustment element 60 that increases or decreases the distance and the angle between the seat bottom portion 46 and the seat back portion 50. The sling 44 may also include additional adjustment elements 60 at any suitable location on the sling 44 or the portable chair frame 10.

III. Additional Portable Chair Elements

The portable chair frame 10 of the described embodiments can also include a cord 62 that functions to couple the elements of the portable chair frame 10 together, as shown in FIG. 6. The first bar section 30 and the second bar section 32 can be hollow such that the cord 62 can couple the inside of the first bar section 30 to the inside of the second bar section 32. The cord can run through the bar sections of a collapsible bar, through the brace, through the bar sections of a second collapsible bar, and through a joint 18 if one of the collapsible bars includes a joint 18. The portable chair frame 10 can include two cords 62 that run through the structure from the corners (the sling interfaces) and function to pull the bar sections, brace, and joints together. The cord 62 can be an elastic cord, but may alternatively be any other suitable material such as fabric, plastic, metal, or a metal spring.

The portable chair frame 10 of the described embodiments may also include a pad. The pad may be coupled to the sling 44 at the seat back portion and/or the seat bottom portion, but may alternatively be coupled to any other suitable portion of the sling and/or the frame. In a first variation, the pads are cushions that are insertable in pockets defined by the sling. The user may insert and remove pads of varying thickness and/or density. In a second variation, the pads are inflatable. In this variation, the pads can be coupled to the sling and include a valve through which they are inflated.

The portable chair frame 10 of the described embodiments may also include rockers. The rockers can be coupled to the joints 18, but may alternatively be coupled to any suitable portion of the portable chair frame 10. The rockers can be standard rockers as conventionally found on standard rocking chairs. The rockers can be rounded bands of material such as wood, metal, or plastic and couple to the ground surface such that the portable chair frame 10 may rock back and forth.

Figure 12A:
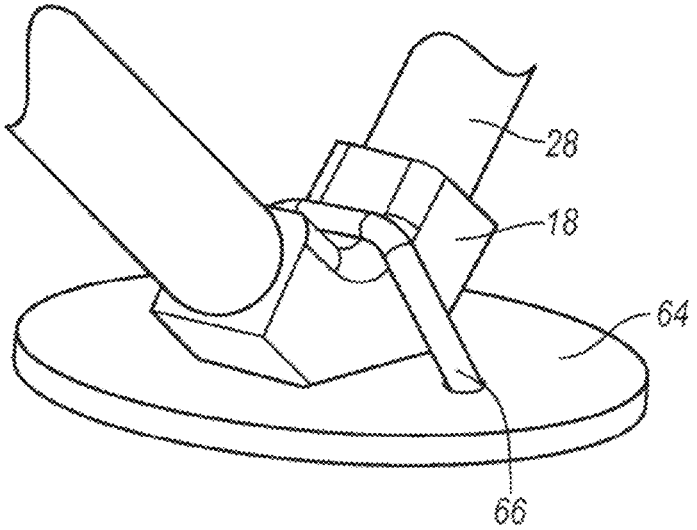
FIGS. 12A and 12B illustrate a first variation and a second variation respectively of the base for the embodiment of FIG. 1.
Figure 12B:
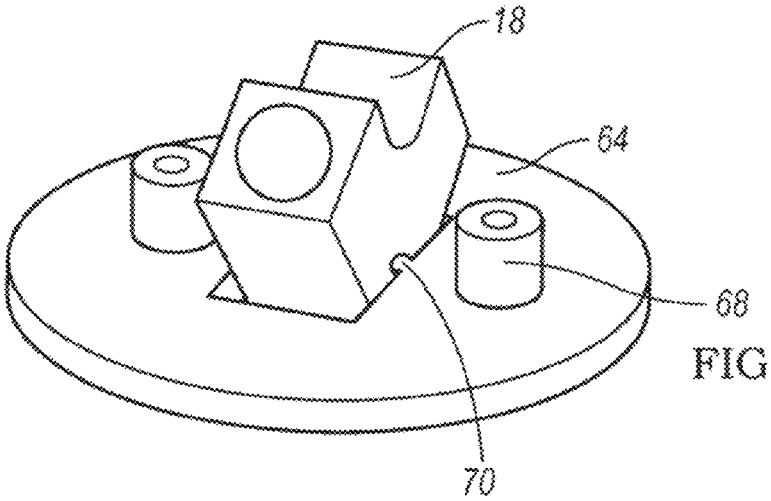
Figure 13:
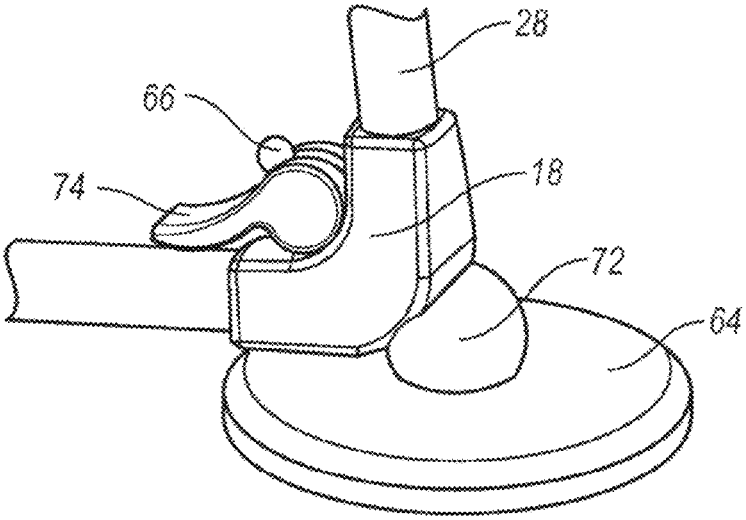
FIG. 13 illustrates a third variation of the base for the embodiment of FIG. 1.

The portable chair frame 10 of the described embodiments can also include a base 64, coupled to the joint 18, that cooperates with the joint 18 to provide a point of contact with the ground surface 20 with an increased surface area, as shown in FIGS. 12A, 12B, and 13. The joints 18 alone provide a point of contact with a ground surface and are ideal for gripping rocks, logs, and hard ground in general. On soft ground such as sand or grass, they may sink into the ground surface. The base 64 coupled to the joint 18, cooperates with the joint 18 to provide a point of contact with the ground surface 20 with an increased surface area such that the joint 18 and base 64 will not sink into the ground surface. The base 64 is removable from the portable chair frame 10, but may alternatively be permanently attached to a portion of the portable chair frame 10. The base 64 is circular and defines a square hole that couples to the joint 18, but may alternatively have any suitable geometry. The base can be made from metal, plastic, polycarbonate, or any other suitable material. The base may be machined, injection molded, or manufactured in any other suitable fashion. In a first variation, as shown in FIGS. 12A and 12B, the base 64 can include a cable 66 that couples the base 64 to the joint 18. The cable 66 can be an elastic cable, but may alternatively be made out of rubber, plastic, fabric, or metal. In a second variation, as shown in FIG. 12B, the base 64 can be injection molded part and includes two hollow bosses 68, located on the upper surface of the base 64 that contain the ends of the cable 66. In this variation, the base 64 may further include tab portions 70 that snap into the joint 18, as shown in FIG. 12B.

In a third variation, as shown in FIG. 13, the base includes a spherical indent on the top side and a center hole with a countersink on the bottom side to hold the cable 66 in place. The depth of the indent and the top surface of the base are contoured in such a way that, on a level ground surface, joint 18 will only hit the base 64 when the portable chair frame is tilted past the point where the pair of collapsible legs that couple to the seat bottom portion of the sling are horizontal or in the opposite direction, past the point where the pair of collapsible legs that couple to the seat back portion of the sling are horizontal. The base 64 can be contoured in such a way that if the bottom (or back) of the joint 18 does contact the base 64, it does so along its entire surface to avoid a lever action, which would overstress the joint. The base 64 in this variation can be injection molded, but may be manufactured in any other suitable fashion.

The base 64 also includes a coupler 72 that can be spherical in shape and dimensioned to couple with the spherical indent in the base 64. The coupler 72 has an hourglass shape hollowed out of the inside of the sphere, such that it provides enough room for the cable 66 in any position that the base 64 and joint 18 can assume. The coupler 72 also keeps the cable at a substantially constant tension as it bends around the center of the coupler 72. The coupler 72 can be injection molded, but may be manufactured in any other suitable fashion. The cable 66 in this variation, can be made from an artificial fiber like nylon or a metal such as steel and may include an elastic element. At a first end of the cable 66, the cable includes a cone shaped plug that interfaces with the countersink geometry of the base 64. At the second end of the cable 66, the cable includes a ball dimensioned such that it can be inserted through a hole in the joint 18 and held by the cam buckle 74 on the opposite side. The cam 74 can be a cylinder with a finger-sized handle. The cam 74 can be slotted to accept the thickness of the cable 66 and has a pocket on the top side to accept the cable ball. The cam 74 can be a standard cam, but may alternatively be any suitable device. The joint 18 in this variation becomes broader towards the back and has a spherical divot to accept the coupler 72. At the crook of the L-shaped joint 18 there is a cylindrical surface for the cam 74 to ride in. It can include a hole from the center of the rear divot to the center of the crook of the L to accept the cable 66. The joint 18 in this variation can be CNC machined aluminum, but may alternatively be any other suitable material machined in any suitable fashion.

Figure 14:
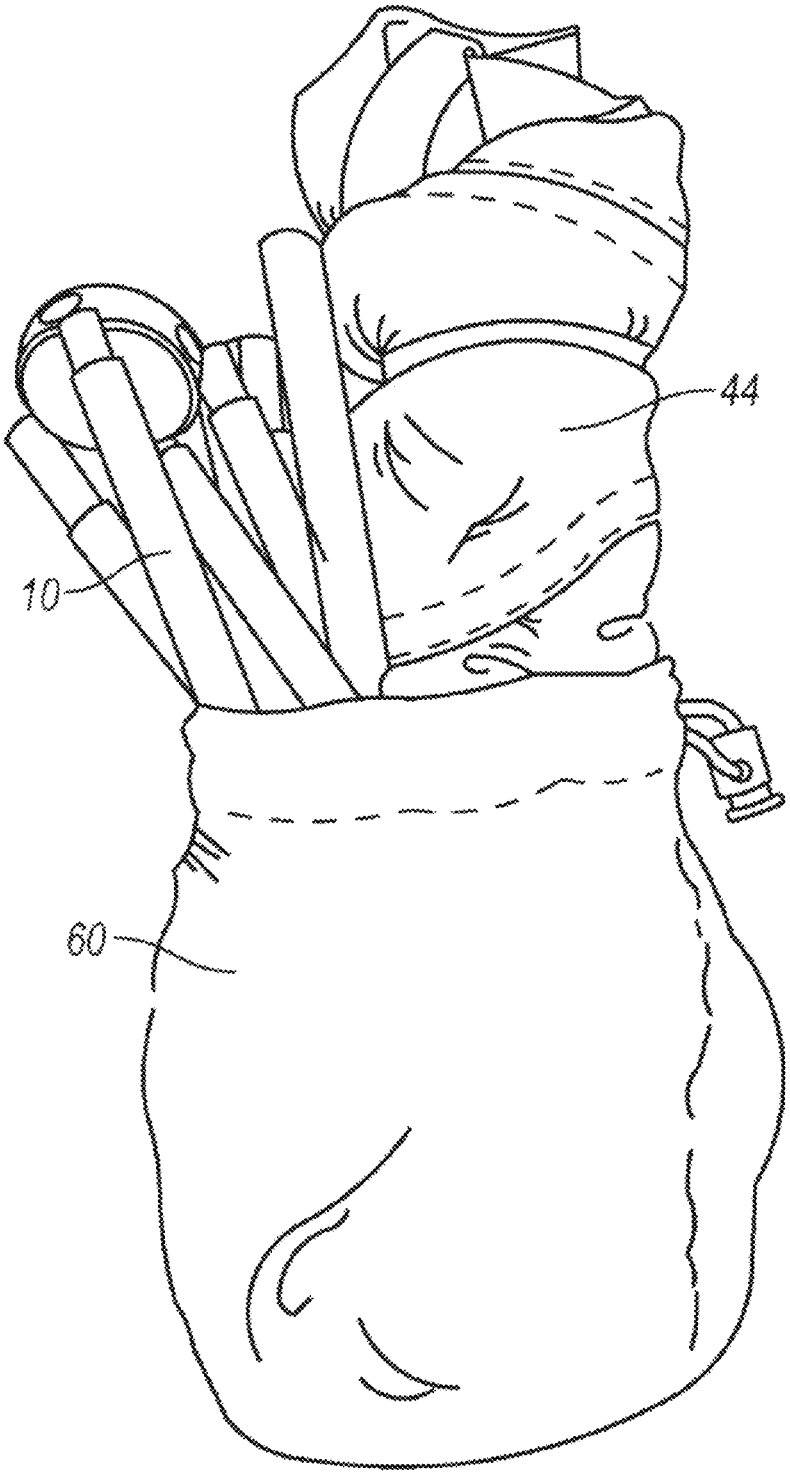
FIG. 14 shows the bag for storing the embodiment of FIG. 1.

The portable chair frame 10 of the described embodiments may also includes a bag 68, as shown in FIG. 14, which functions to store the portable chair frame 10 and the sling 44, when they are collapsed and folded. The bag 68 has a length less than 10 inches (ideally less than or equal to 7 inches) and a diameter less than 5 inches (ideally less than or equal to 4 inches), but may alternatively have any suitable dimensions to store the portable chair frame 10 and/or the sling 44, when they are collapsed and folded. The sling can be removed from the portable chair frame when they are collapsed and folded, but alternatively, the sling may remain coupled to the portable chair frame when they are collapsed and folded and/or the sling and frame may open in a fashion similar to the opening and closing mechanism of an umbrella, i.e. the portable chair frame and/or sling may pop open in a smooth motion similar to that of an umbrella opening and unfolding in one fluid motion.

IV. Additional Portable Chair Embodiments

Figure 15A:
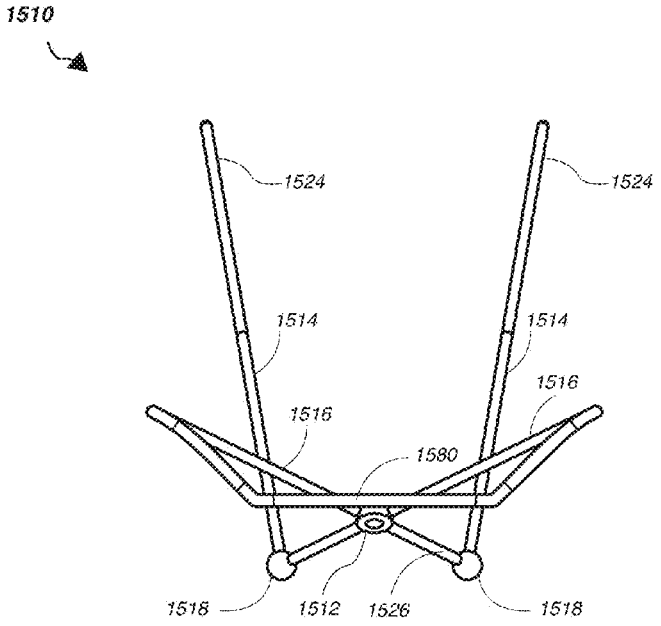
FIGS. 15A and 15B are perspective views illustrating another embodiment of a portable chair frame in accordance with the present invention.
Figure 15B:
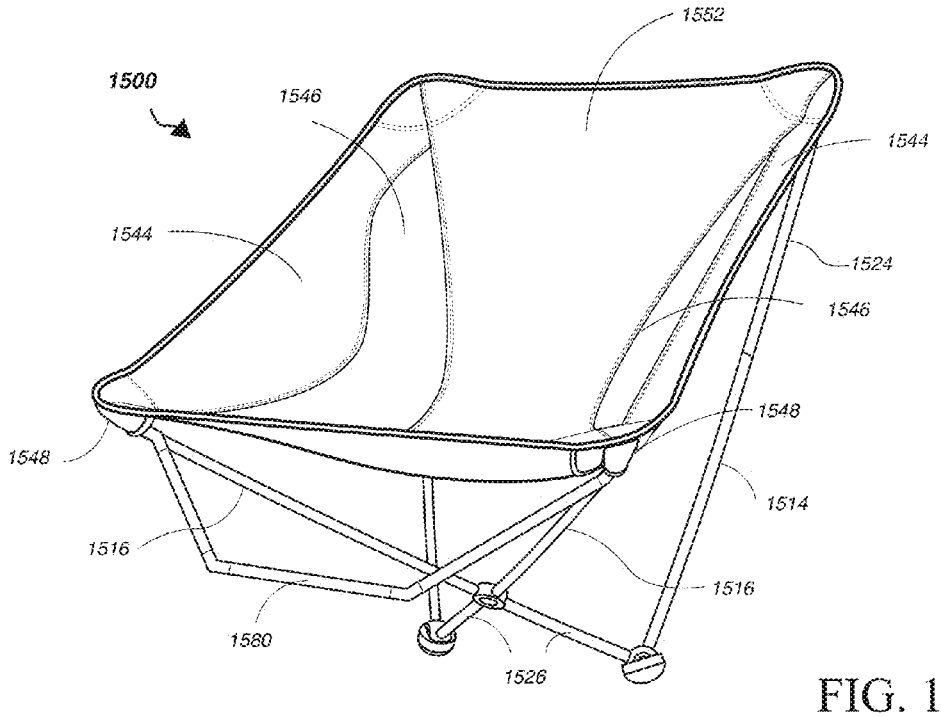

FIGS. 15A and 15B are perspective views illustrating another embodiment of a portable chair 1500 having a chair frame 1510 and sling sections 1544, 1546 & 1552, in accordance with the present invention. Chair frame 1510 has similar components to those of the above-described chair frame 10, including a first pair of collapsible bar sections 1514, 1524 a second pair of collapsible bar sections 1516, 1526, brace 1512, and two joints 1518 that each provide a point of contact with a ground surface (not shown). Construction, field assembly and functionality of chair frame 1510 and sling sections 1544, 1546 & 1552 are substantially similar to that described above for the portable chair components including chair frame 10, sling 44 and gusset 52 of FIG. 2.

For example, the first pair of collapsible bar sections 1514, 1524 are coupled to each other in a manner similar to that described above for collapsible bar 28 having first and second bar sections 30, 32 that are removably coupled as illustrated by FIG. 6. Accordingly, the first bar section 1514 has an end portion with an outer diameter dimension, and the second bar section 1524 has an end portion that defines a recess that receives the outer diameter dimension of the end portion of the first bar section 1514.

Sling sections 1544 and 1552 can be made from a suitable lightweight nylon material, while sling section 1546 can be made from a mesh material for improved air ventilation and/or conformity with the user's body. Four frame interfaces 1548, described in greater detail below, are securely attached to the four respective corners formed by sling sections 1544 and 1552.

Figure 16:
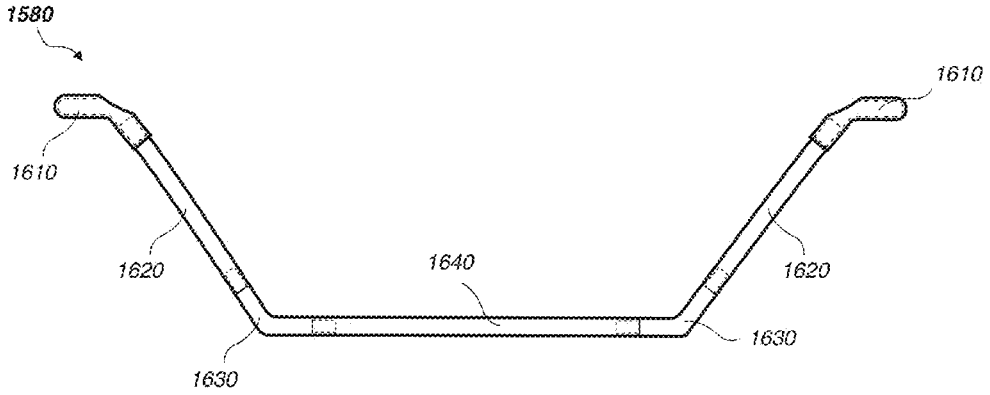
FIG. 16 is a perspective view of the optional front foot assembly for the embodiment of FIGS. 15A and 15B.
Figure 17:
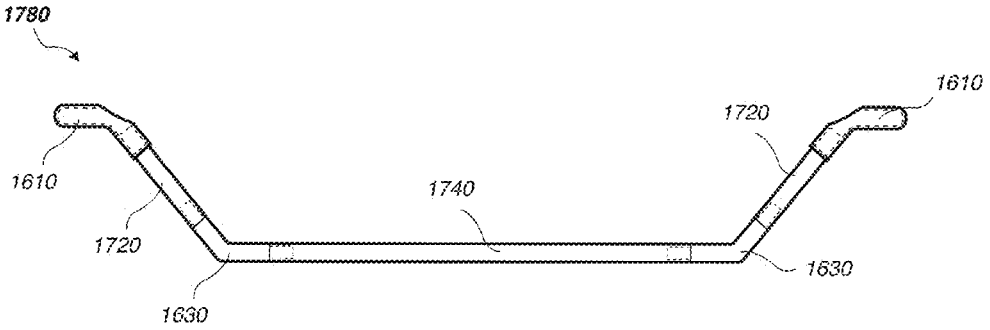
FIG. 17 is a perspective view of a variation of the front foot assembly of FIG. 16 suitable for portable chairs in accordance to the present invention.

In this embodiment, portable chair frame 1510 also includes an optional front support assembly 1580 which is shown in greater detail in the perspective view of FIG. 16. Front support assembly 1580 provides additional stability for a user sitting in chair 1500. Assembly 1580 includes a pair of connectors 1610, a pair of diagonal bars 1620, a pair of couplers 1630, and a bottom bar 1640. The respective lower ends of diagonal bars 1620 are coupled to opposite ends of bottom bar 1640 via couplers 1630.

Figure 18A:
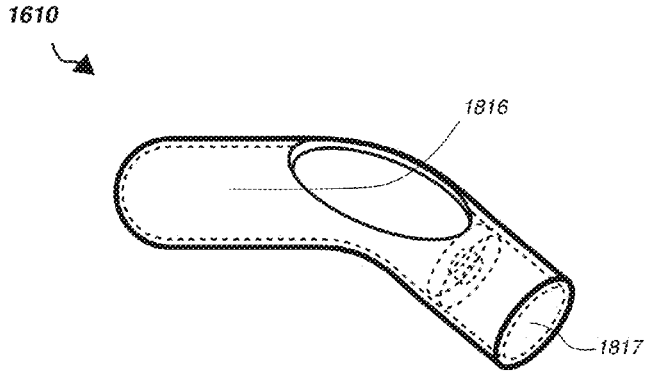
FIGS. 18A and 18B are perspective and cross-sectional views, respectively, of an exemplary connecting joint for the front foot assemblies of FIGS. 16 and 17.
Figure 18B:
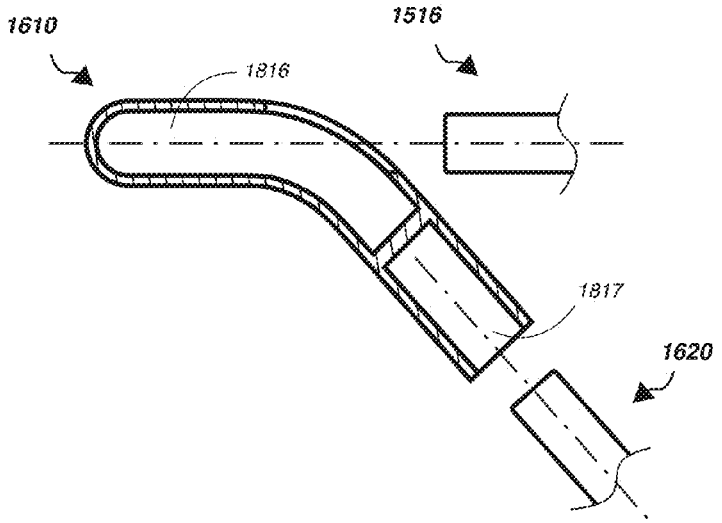

Referring also to FIGS. 18A and 18B which are perspective and cross-sectional views, respectively, of exemplary connector 1610, connector 1610 has a first recess 1816 configured to rotatably secure collapsible bar 1516, and a second recess 1817 to rotatably secure an upper end of diagonal bar 1620. Note that connector 1610 is also configured to be coupled to the front frame interfaces 1548, attached to the sling sections 1544 and 1552.

Figure 18C:
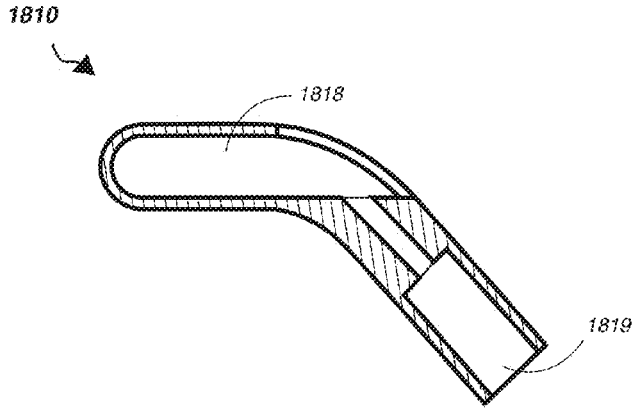
FIG. 18C is a cross-sectional view showing a variant of the machined connecting joint of FIG. 18B.

Connecting joint 1610 can be made from suitable material such as a metallic or plastic casting. FIG. 18C is a cross-sectional view showing another embodiment of a connector 1810 having machined recesses 1818, 1819 suitable for securing bars 1516, 1620, respectively.

Figure 21A:
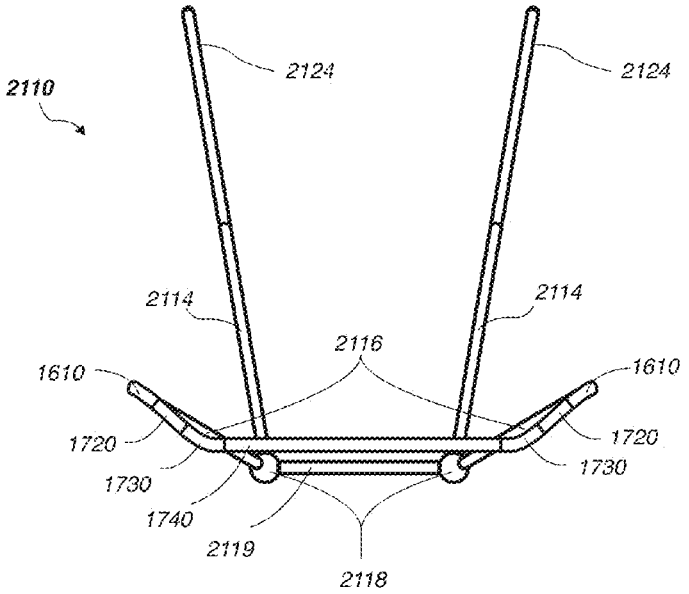
FIGS. 21A-21D are perspective views illustrating another embodiment of a portable chair, in accordance with the present invention.
Figure 21B:
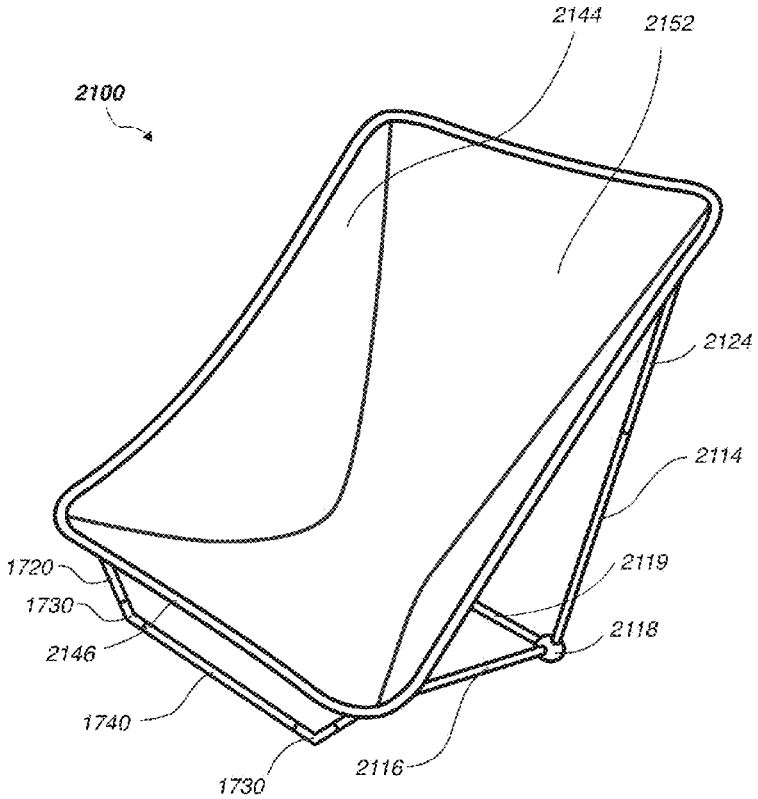
Figure 21C:
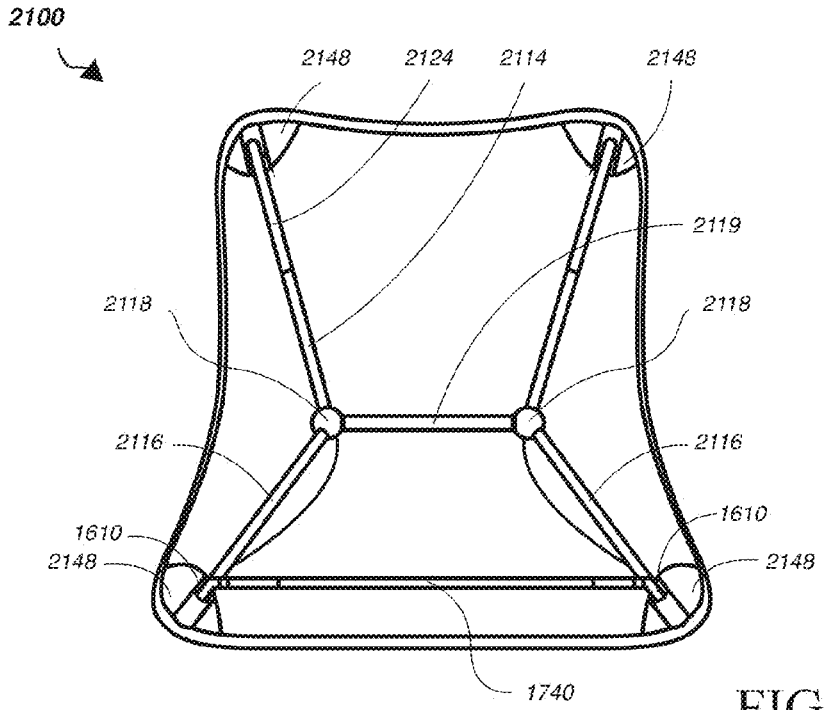
Figure 21D:
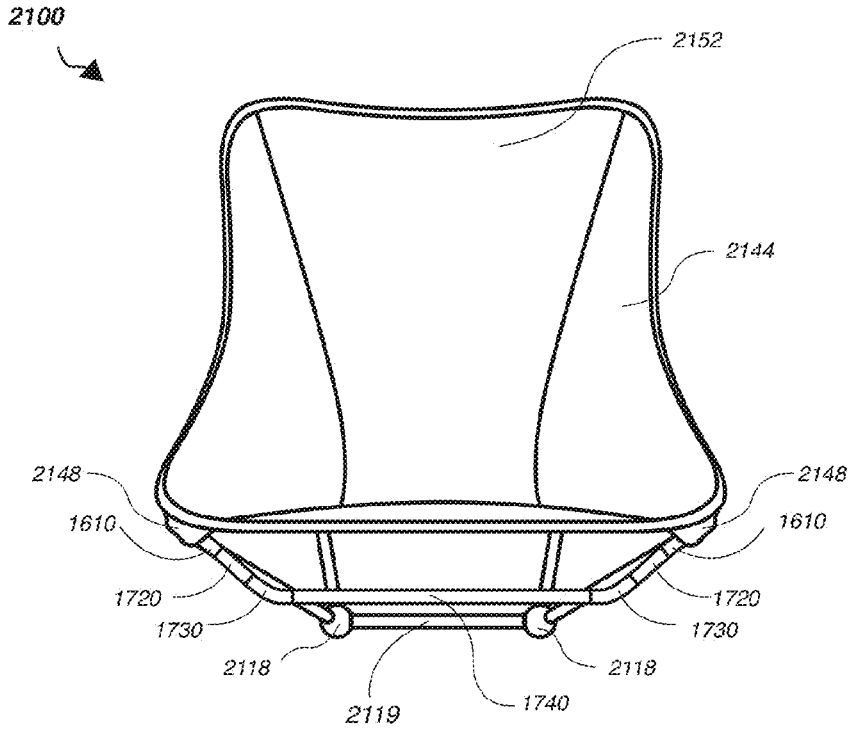

FIGS. 21A-21D are perspective views illustrating another embodiment of a portable chair 2100 having a chair frame 2110 and sling sections 2144, 2152, in accordance with the present invention. FIG. 21A shows a chair frame 2110 of chair 2100. FIGS. 21B, 21C and 21D show side, back and front views of portable chair 2100. Chair frame 2110 includes a first pair of collapsible bar sections 2114, 2124 a second pair of collapsible bars 2116 and two joints 2118 that each provide a point of contact with a ground surface (not shown). Construction, field assembly and functionality of chair frame 2110 and sling sections 2144, 2152 are somewhat similar to that described above for the components of portable chair 1500.

In this embodiment, the lower ends of bar sections 2114 and bars 2116 are coupled to each other via joints 2118. In addition, joints 2118 are coupled to each other via a bottom bar 2119. Portable chair frame 2110 can include an optional front support assembly 1780 which is shown in greater detail in the perspective view of FIG. 17. Front support assembly 1780 provides additional stability for a user sitting in chair 2100. Assembly 1780 includes a pair of connectors 1610, a pair of diagonal bars 1720, a pair of couplers 1630, and a bottom bar 1740. The respective lower ends of diagonal bars 1720 are coupled to opposite ends of bottom bar 1740 via couplers 1630. Connectors 1610 are configured to be coupled to front frame interfaces 2148 of the sling sections 2144, 2152.

Figure 19A:
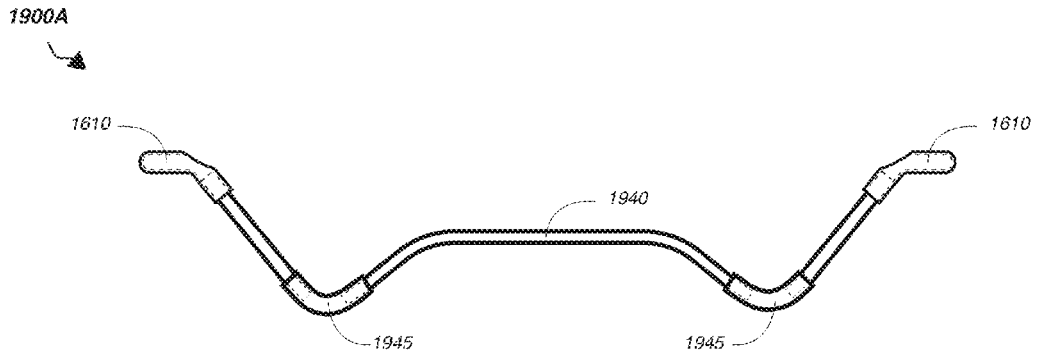
FIGS. 19A, 19B and 19C are perspective views of alternate front foot assemblies for portable chairs in accordance with the present invention.
Figure 19B:
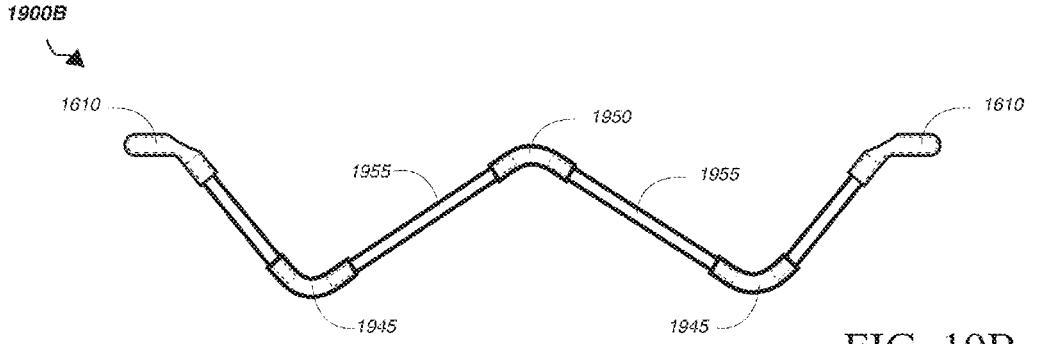
Figure 19C:
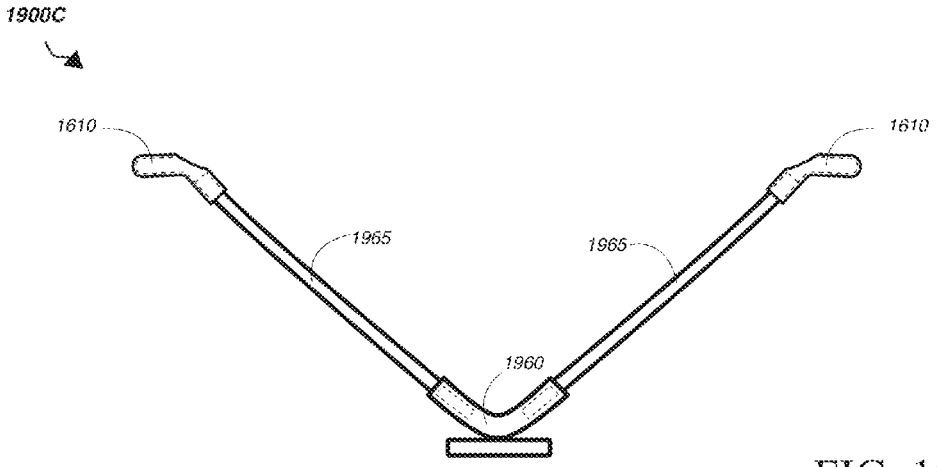

FIGS. 19A and 19B are perspective views of alternate exemplary front support assemblies 1900A and 1900B suitable for portable chairs such as chairs 1500, 2100. FIG. 19C shows yet another exemplary embodiment of a front support assembly 1900C. Adding front foot assembly 1900C to a portable chair creates a three ground contact points with a ground surface, thereby increasing stability especially for uneven ground surfaces.

Figure 22A:
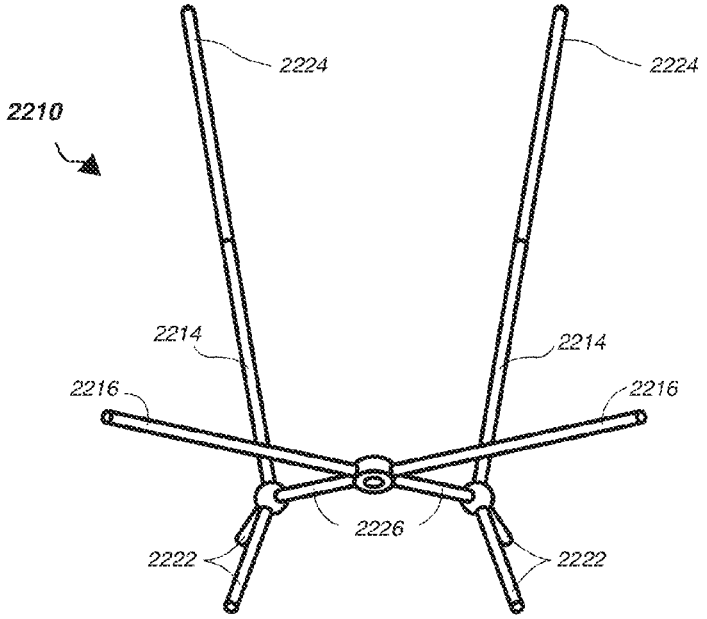
FIGS. 22A-22D and 23A-23C are perspective views illustrating two additional embodiments of portable chairs having bipod legs, in accordance with the present invention.
Figure 22B:
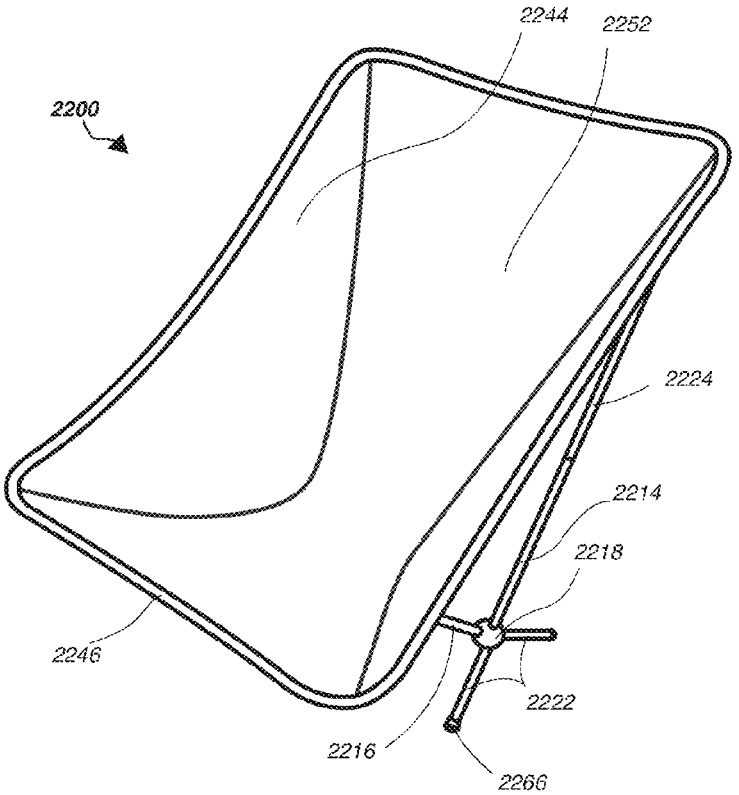
Figure 22C:
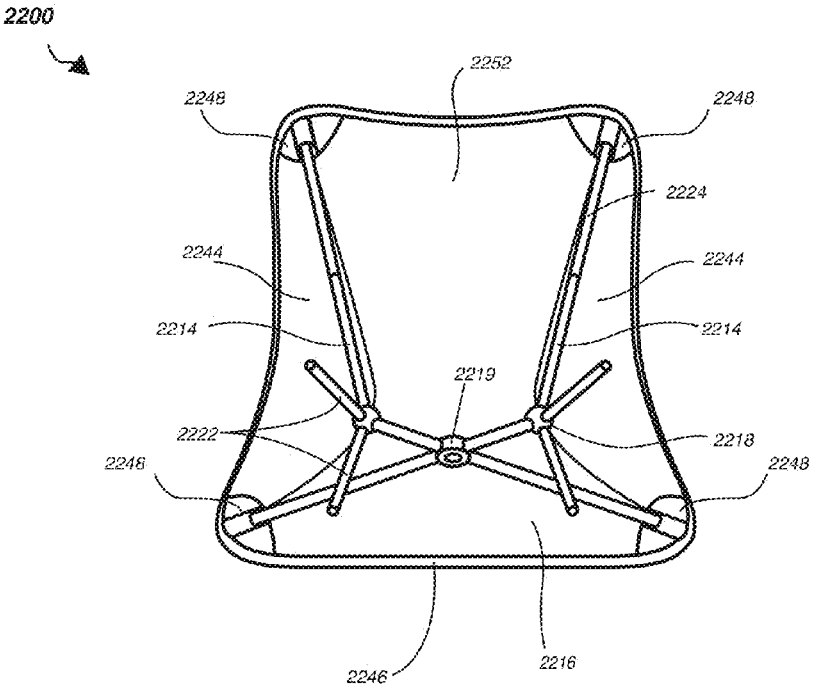
Figure 22D:
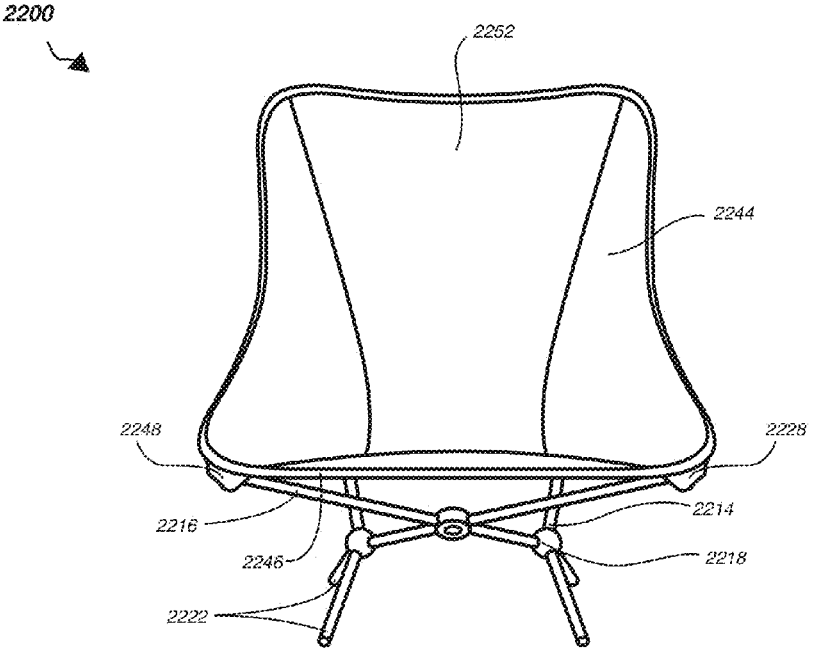

FIGS. 22A-22D are perspective views of an additional embodiment of a portable chair 2200 having a chair frame 2210 and sling sections 2244, 2252, in accordance with the present invention. FIG. 22A shows chair frame 2210 while FIGS. 22B, 22C and 22D show side, back and front views of portable chair 2200.

Chair frame 2210 has similar components to those of the above-described chair frame 1510, including a first pair of collapsible bar sections 2214, 2224 a second pair of collapsible bar sections 2216, 2226, brace 2212, and two joints 2218 each coupled to a corresponding pair of bipod legs 2222. Construction, field assembly and functionality of chair frame 2210 and sling sections 2244, 2252 share some similarities with the components of portable chairs 1500 and 2100 described above.

In this embodiment, stability for a user sitting in chair 2100 is accomplished by bipod legs 2222 providing four points of contact with the ground surface as illustrated by FIG. 22D. Bar sections 2214, 2226 and bipod legs 2222 can be coupled to joints 2218 in a manner similar to that described below for joint 2318 and bar section 2314, bar 2316 and bipod legs 2222 as illustrated by FIG. 24.

Figure 23A:
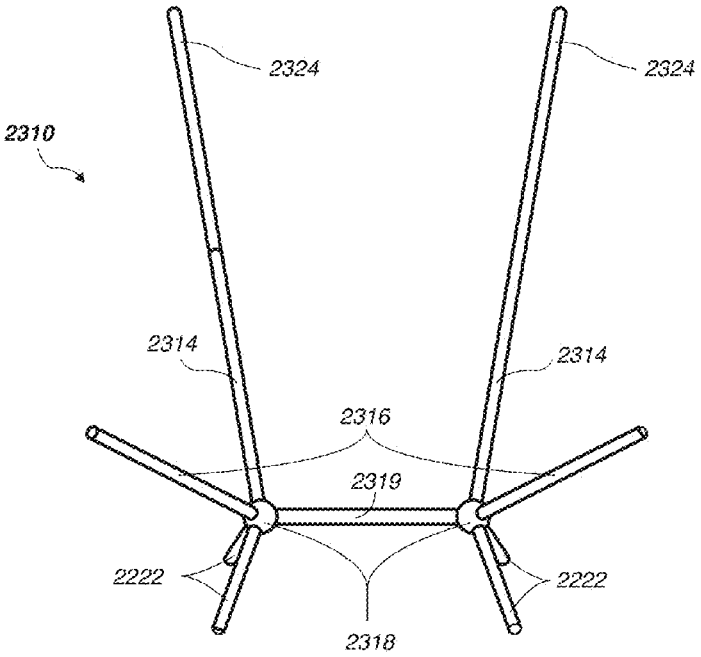
Figure 23B:
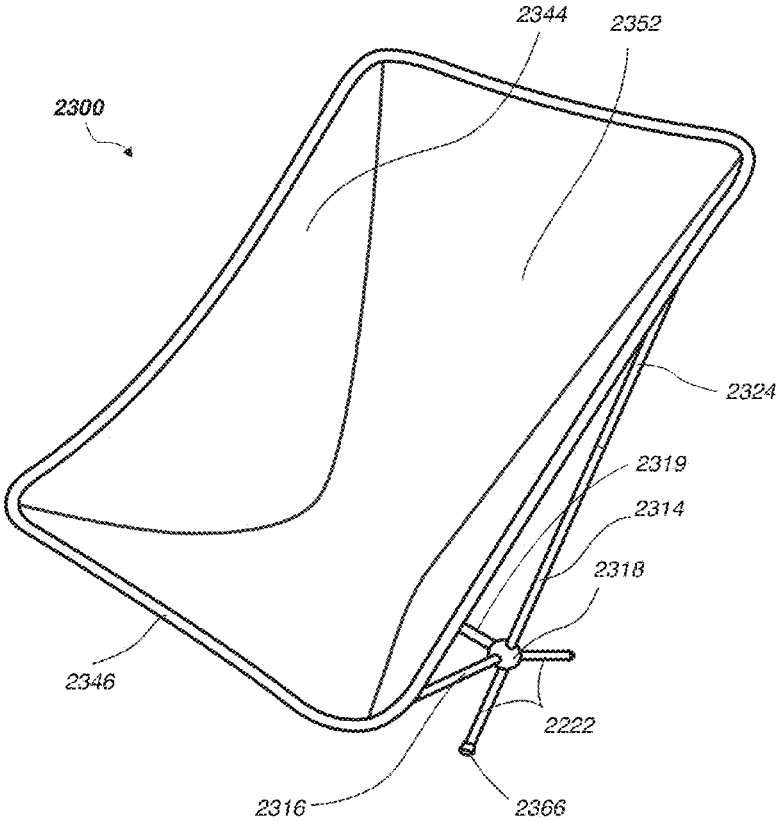
Figure 23C:
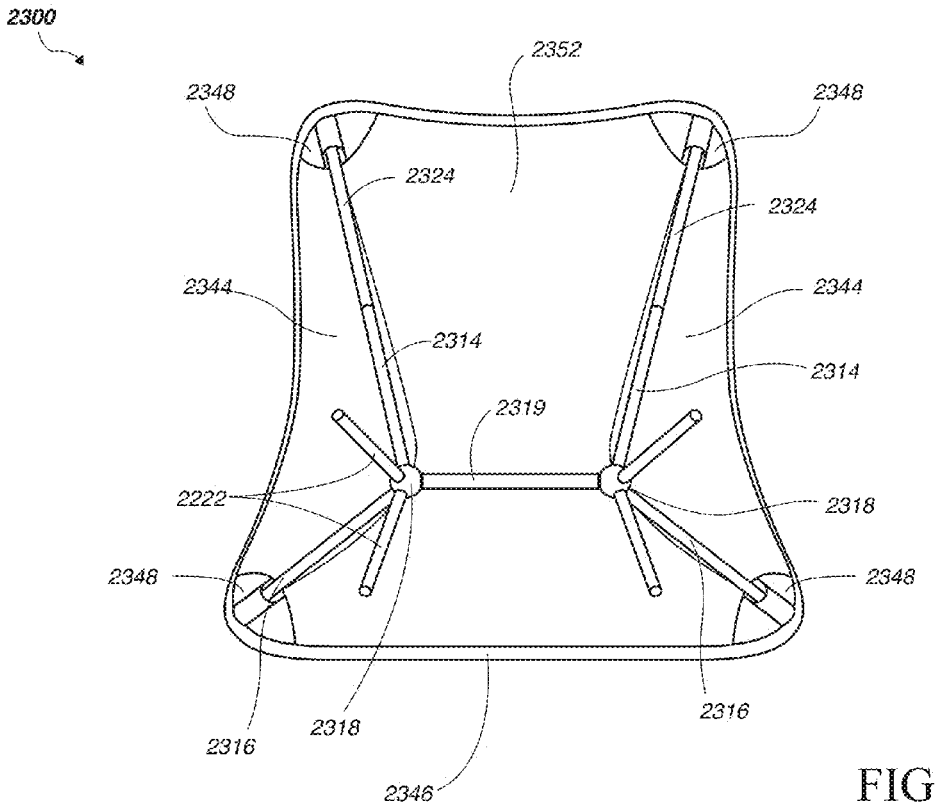

FIGS. 23A-23C are perspective views illustrating yet another embodiment of a portable chair 2300 with chair frame 2310 and sling sections 2344, 2352, in accordance with the present invention. FIG. 23A shows chair frame 2310 while FIGS. 23B and 23C show side and back views of portable chair 2300. Chair frame 2310 includes a first pair of collapsible bar sections 2314, 2324 a second pair of collapsible bars 2316 and two joints 2318 each coupled to a corresponding pair of bipod legs 2222. Construction, field assembly and functionality of chair frame 2310 and sling sections 2144, 2152 share some similarities to that described above for portable chairs 1510, 2100 and 2210.

In this embodiment, the lower ends of bar sections 2314 and bars 2316 are couple to each other via joints 2318. In addition, joints 2318 are coupled to each other via a horizontal bar 2319. Additional stability for a user sitting in chair 2300 is accomplished by bipod legs 2222 providing four points of contact with the ground surface as illustrated by FIGS. 23A and 23B.

Figure 24:
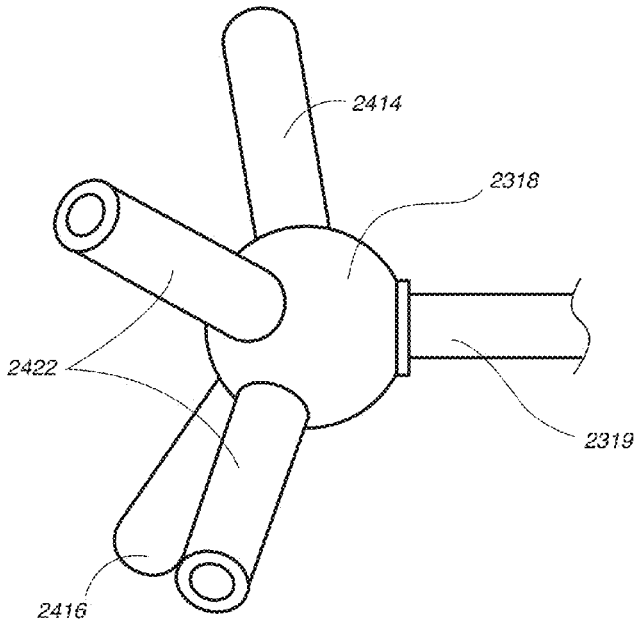
FIG. 24 is a perspective view of an exemplary ball joint useful constructing some of the embodiments of the portable chairs described.

FIG. 24 is a perspective view of exemplary joint 2318 with four stubs 2414, 2416, 2422 configured to snugly couple with corresponding ends of bar section 2314, bar 2316 and bipod legs 2222, in a manner similar to that described above for collapsible bar 28 and as illustrated by FIG. 6. For example, the external diameters of stubs 2414, 2416, 2422 are appropriately selected to receive the respective end internal diameters of bars 2314, 2316 and legs 2222.

Figure 20A:
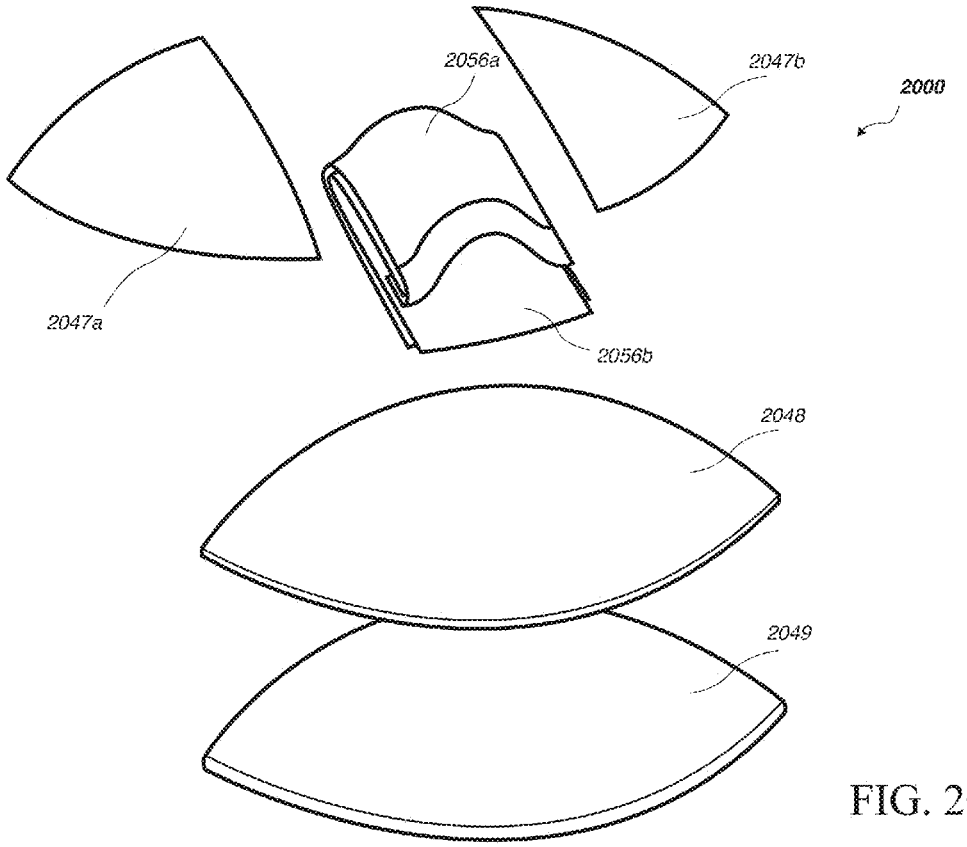
FIGS. 20A and 20B are exploded and assembled views, respectively, of the frame interface suitable for the portable chair slings in accordance with the present invention.
Figure 20B:
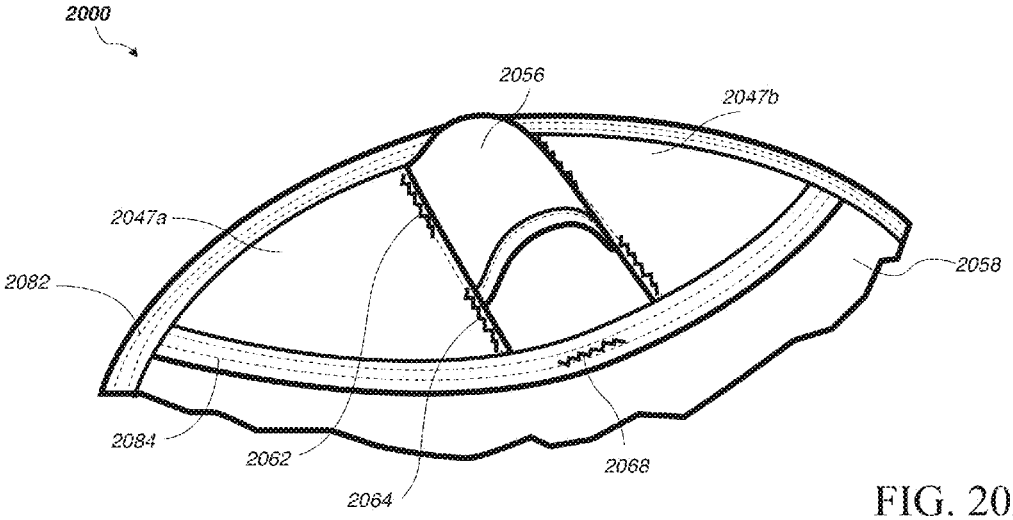

Referring now to FIGS. 20A and 20B, exploded and assembled views, respectively, of an exemplary frame interface 2000 suitable for coupling slings to the respective frames of the portable chairs, e.g., chairs 1500, 2100, 2200 and 2300, frame interface 2000 includes reinforcing layers 2047*a*, 2047*b*, 2056*a*, pocket layer 2056*b*, stiffening layer 2048 and backing layer 2049.

In some embodiments, reinforcing layers 2047*a*, 2047*b*, 2056*a* can be made from the same lightweight material as sling sections 1544, 1552, e.g., ripstop nylon. Pocket layer 2056*b* can be made from a suitable thick and strong material such as nylon webbing. Stiffening layer 2048 can be mode from a suitably stiff material such as High Density Polyethylene (HDPE), while backing layer 2049 can be made from a suitably material such as Ethyl Vinyl Acetate (EVA). These layers can be stitched to form a pocket 2056 for sling section 2058, as shown in FIG. 20B together with edging tape 2082, 2084. Additional reinforcing stitches can also be applied to stress locations such as 2062, 2064, 2068.

The exemplary embodiments of the portable chairs described above can be made from a wide variety of suitable materials. For example, the frames can be constructed from one or more strong and lightweight materials including metallic alloys such as aluminum, titanium, magnesium and steel. It is also possible to use plastics such as polycarbonate or fiberglass, carbon fiber, and combinations thereof. It may also be possible to construct chair frames using natural materials such as bamboo. The chair slings can be made from suitable flexible materials such as nylon, canvas and jute and combinations thereof.

Many modifications and additions to the above described embodiments are possible. In addition, many of the portable chair components, including connectors, couplers and joints described above, can also useful for constructing other assemblies. For example, connectors 1610 described above for mounting front support assemblies 1580, 1780, 1900A, 1900B, 1900C to portable chairs also useful for mounting assemblies for other portable structures and furniture, including cots beds, tables, and shelters such as tents.

V. Additional Hub Assemblies for Portable Chairs

FIGS. 25 to 34D are views illustrating additional embodiments of portable chair hub assemblies for the portable chairs described above. Note that many of the figures are intended to be illustrative and hence have, for example, not been drawn to scale or show all hidden details. Accordingly, one skilled in the art will be able to implement many embodiments of portable chair hub assemblies based on the detailed description and figures provided, by varying, for example, dimensions of one or more components while remaining with the scope and spirit of the present invention.

Figure 25:
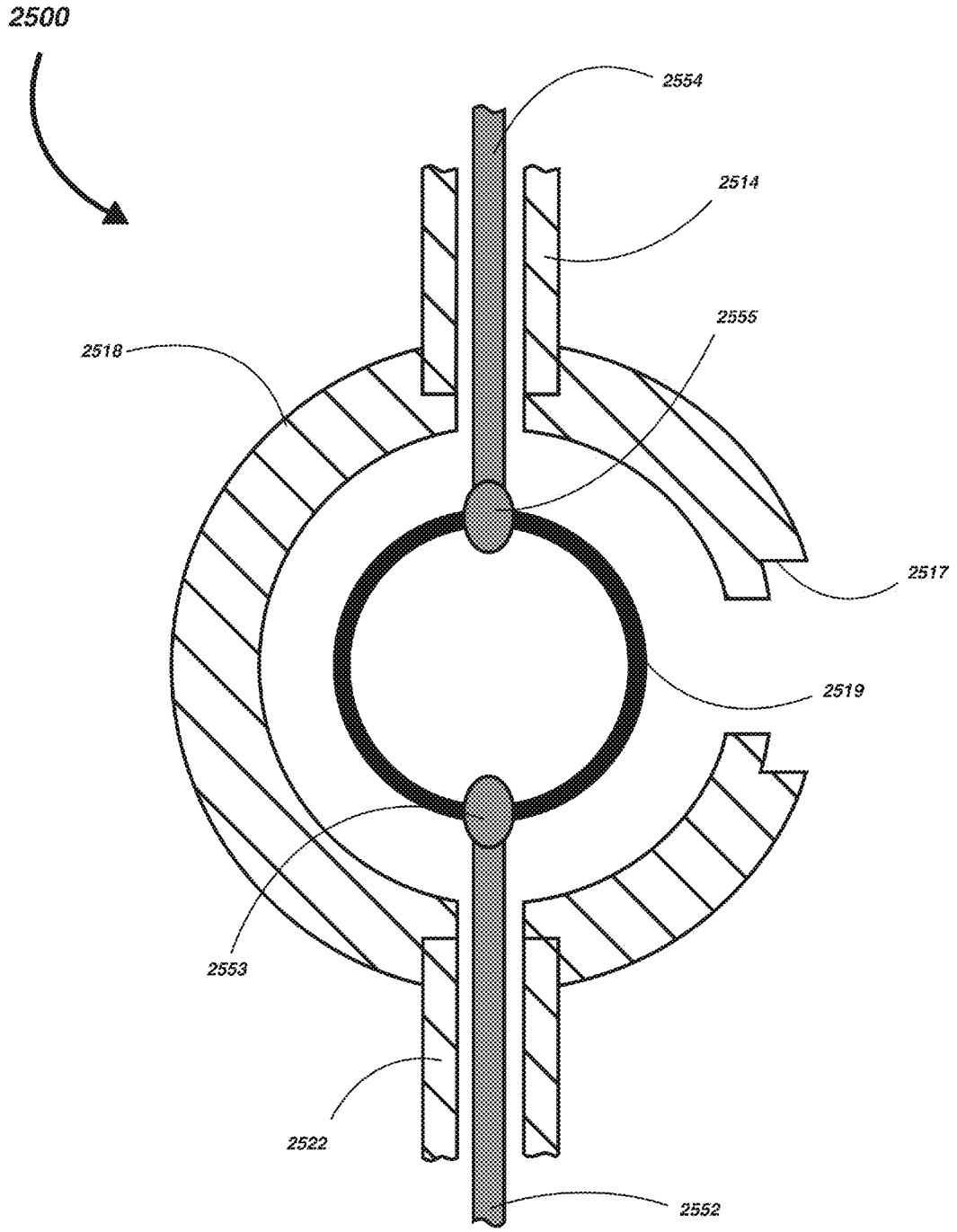
FIGS. 25 to 33 illustrate additional embodiments of portable chair hub assemblies for various embodiments of portable chairs in accordance with the present invention.

FIG. 25 is a cross-sectional view of another embodiment of hub assembly 2500 showing a first elastic cord 2554 and a second elastic cord 2552 coupled to a ring 2519 by knots 2555, 2553, respectively, thereby enabling the respective hollow bars 2514, 2522 to be retained to joint 2518 in the assembled state until separated into the collapsed state. In this embodiment, joint 2518 also includes an opening 2517 configured to accept a cross member (not shown) coupled to a corresponding joint (not shown).

Figure 26:
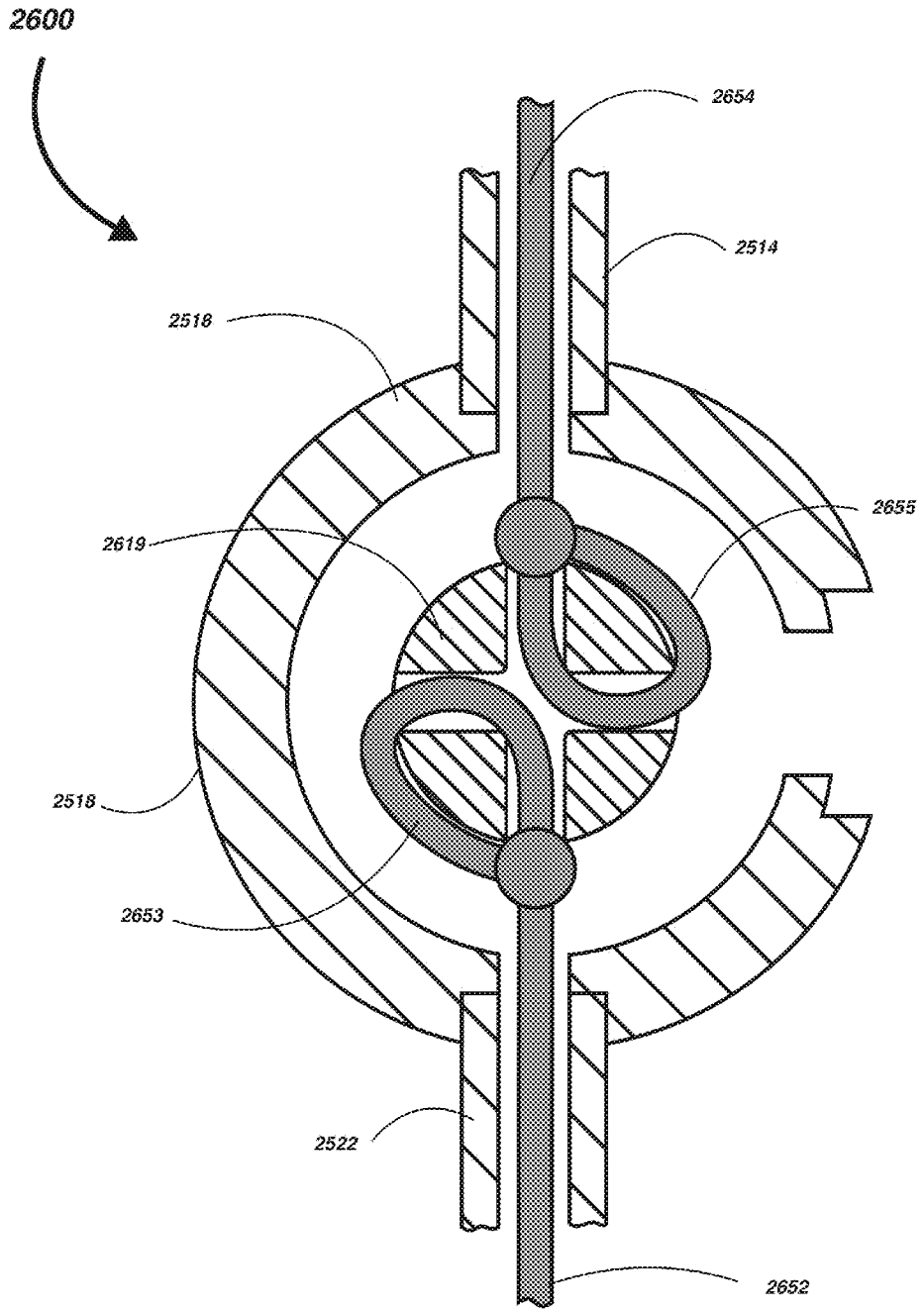

Similarly, FIG. 26 is a cross-sectional view of another embodiment of hub assembly 2600 showing a first elastic cord 2654 and a second elastic cord 2652 coupled to a terminal 2619 by loops 2655, 2653, respectively, thereby enabling the respective hollow bars 2514, 2522 to be retained to joint 2518 in the assembled state until separated into the collapsed state.

Figure 27:
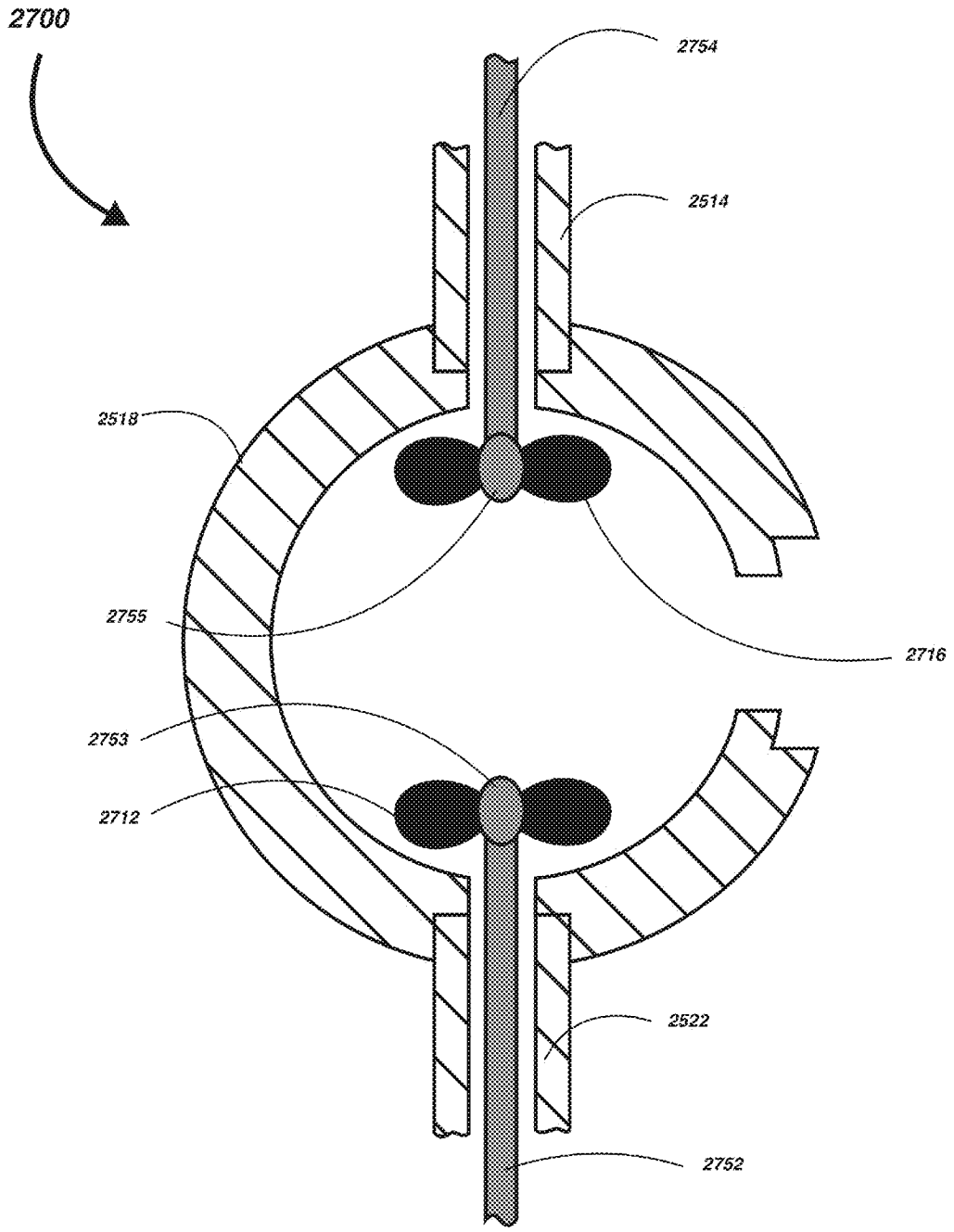

FIG. 27 is a cross-sectional view of yet another hub assembly 2700 including elastic cords 2752, 2754, terminals 2716, 2712, hollow bars 2514, 2522 and a joint 2518. Elastic cord 2754 is coupled to terminal 2716 via knot 2755, while elastic cord 2752 is coupled to terminal 2718 via knot 2753, thereby enabling the respective hollow bars 2514, 2522 to be retained to joint 2518 in the assembled state until separated into the collapsed state.

Figure 28:
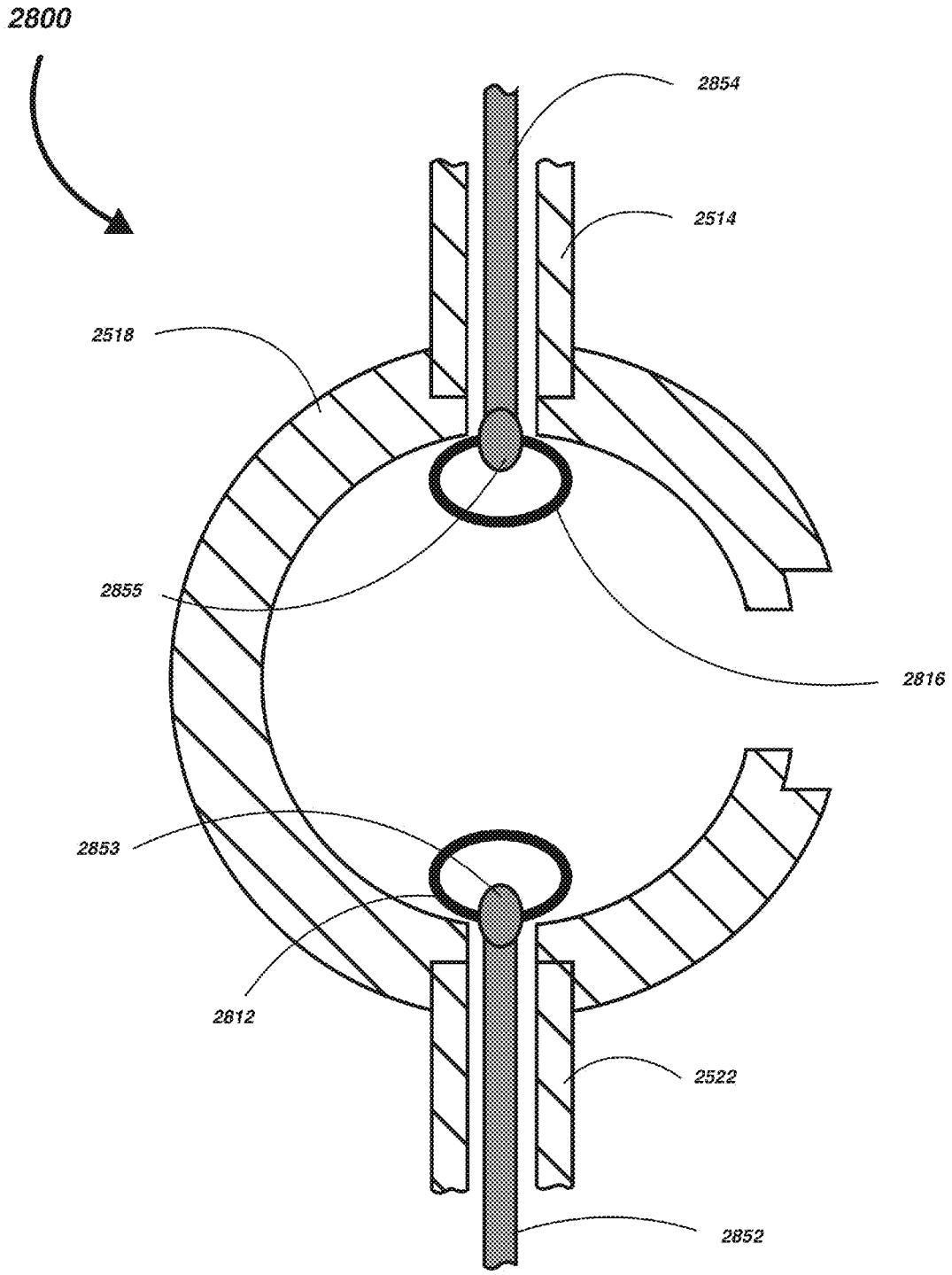

Similarly, FIG. 28 is a cross-sectional view of another hub assembly 2800 including elastic cords 2852, 2854, rings 2816, 2812, and a joint 2518. Elastic cord 2854 is coupled to ring 2816 via knot 2855, while elastic cord 2852 is coupled to ring 2812 via knot 2853, thereby enabling the respective hollow bars 2514, 2522 to be retained to joint 2518 in the assembled state until separated into the collapsed state.

Figure 29:
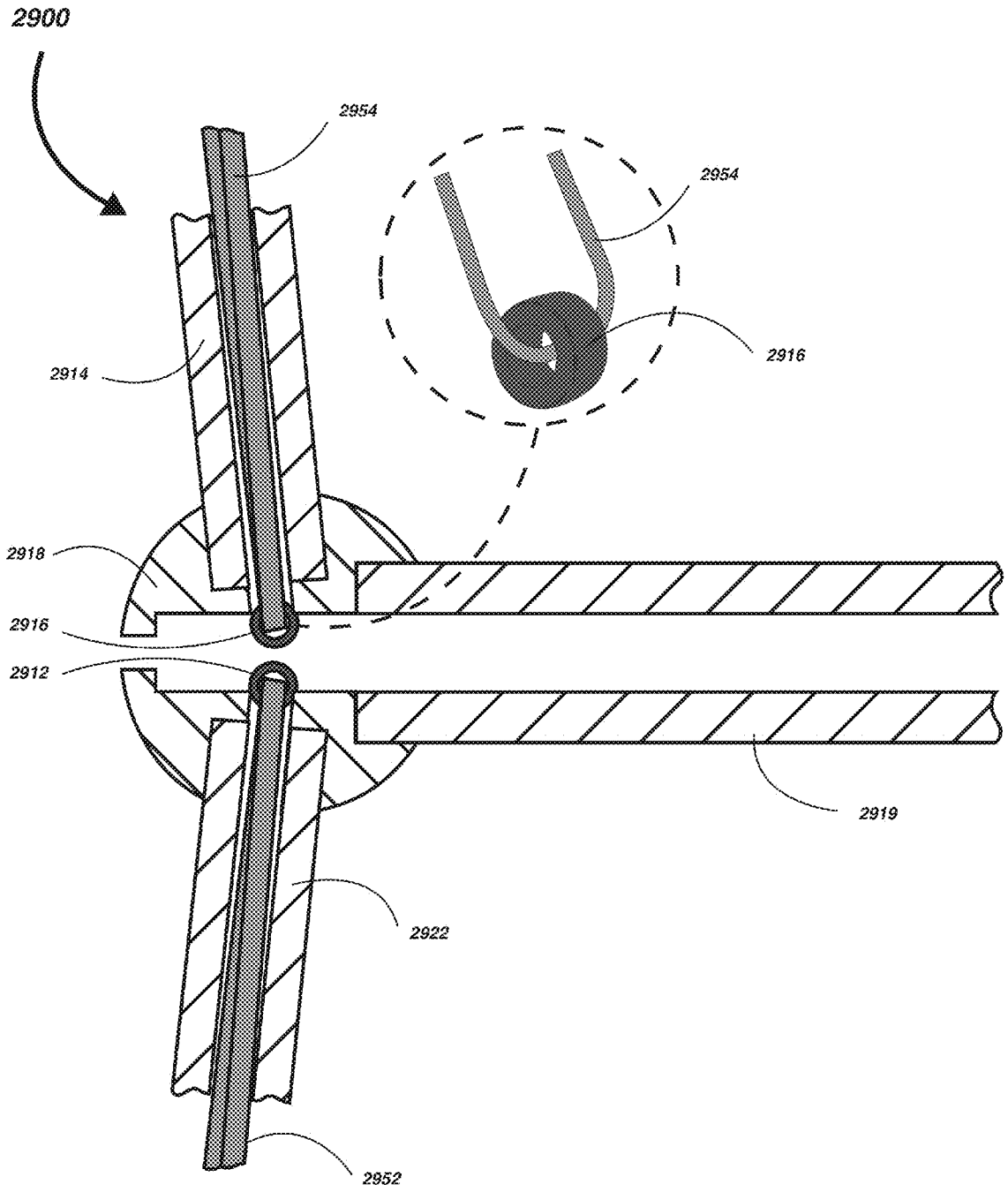

FIG. 29 is a cross-sectional view of yet another hub assembly 2900 including elastic cords 2952, 2954, rings 2916, 2912, hollow bars 2914, 2922, a cross member 2919 and a joint 2918. In this embodiment, elastic cord 2954 is looped through ring 2916, while elastic cord 2952 is looped through ring 2912, thereby enabling the respective hollow bars 2914, 2922 to be retained to joint 2918 in the assembled state until separated into the collapsed state.

Figure 30A:
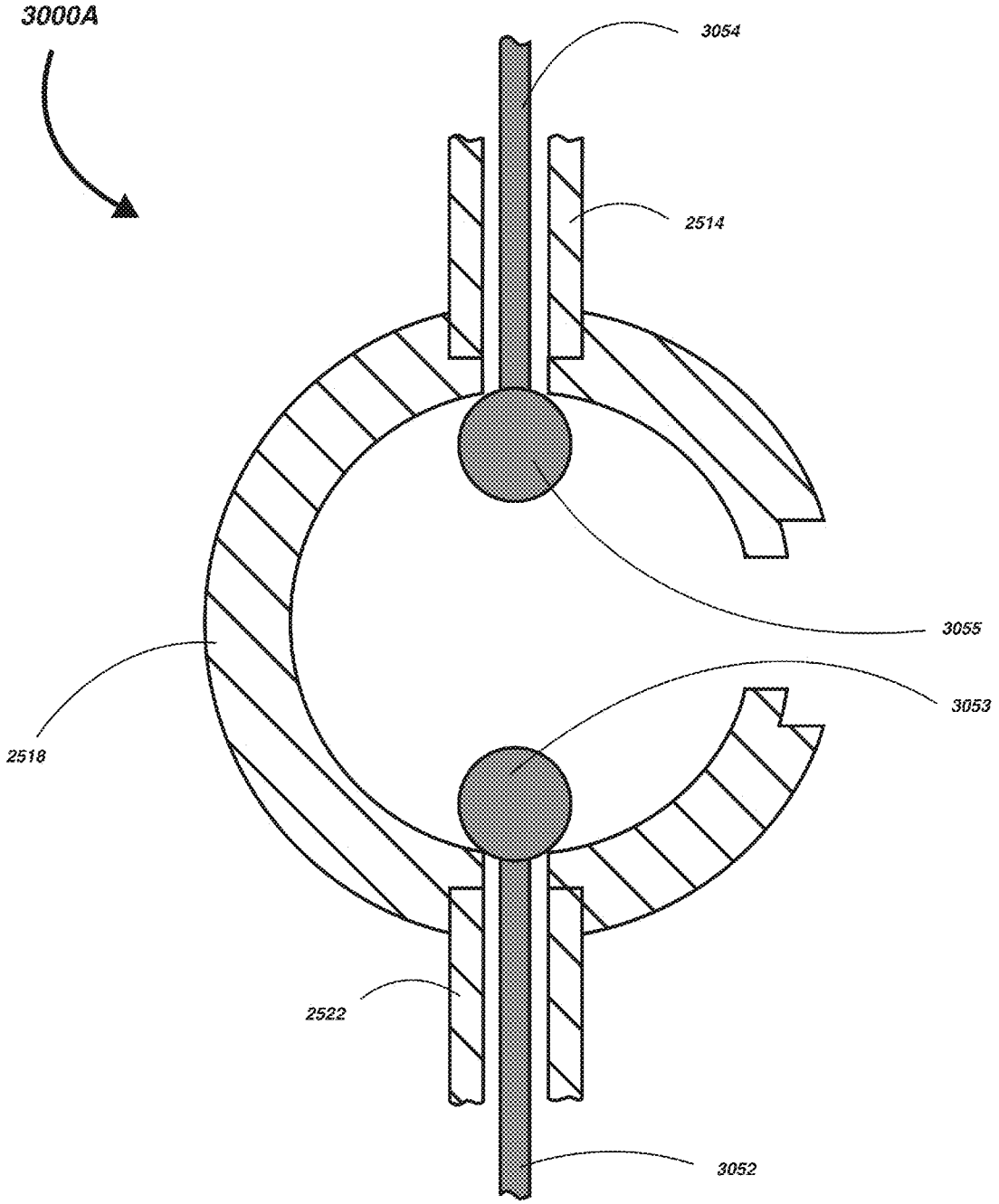

As shown in FIG. 30A, a cross-sectional view of hub assembly 3000A, it is also possible to retain hollow bars 2522, 2514 to joint 2518 using elastic cords 3052, 3054, respectively, wherein the cords 3052, 3054 include oversized terminations, such as knots 3053, 3055, respectively. Other suitable oversized terminations include welds which can be substitutes for the knots 3053, 3055.

Figure 30B:
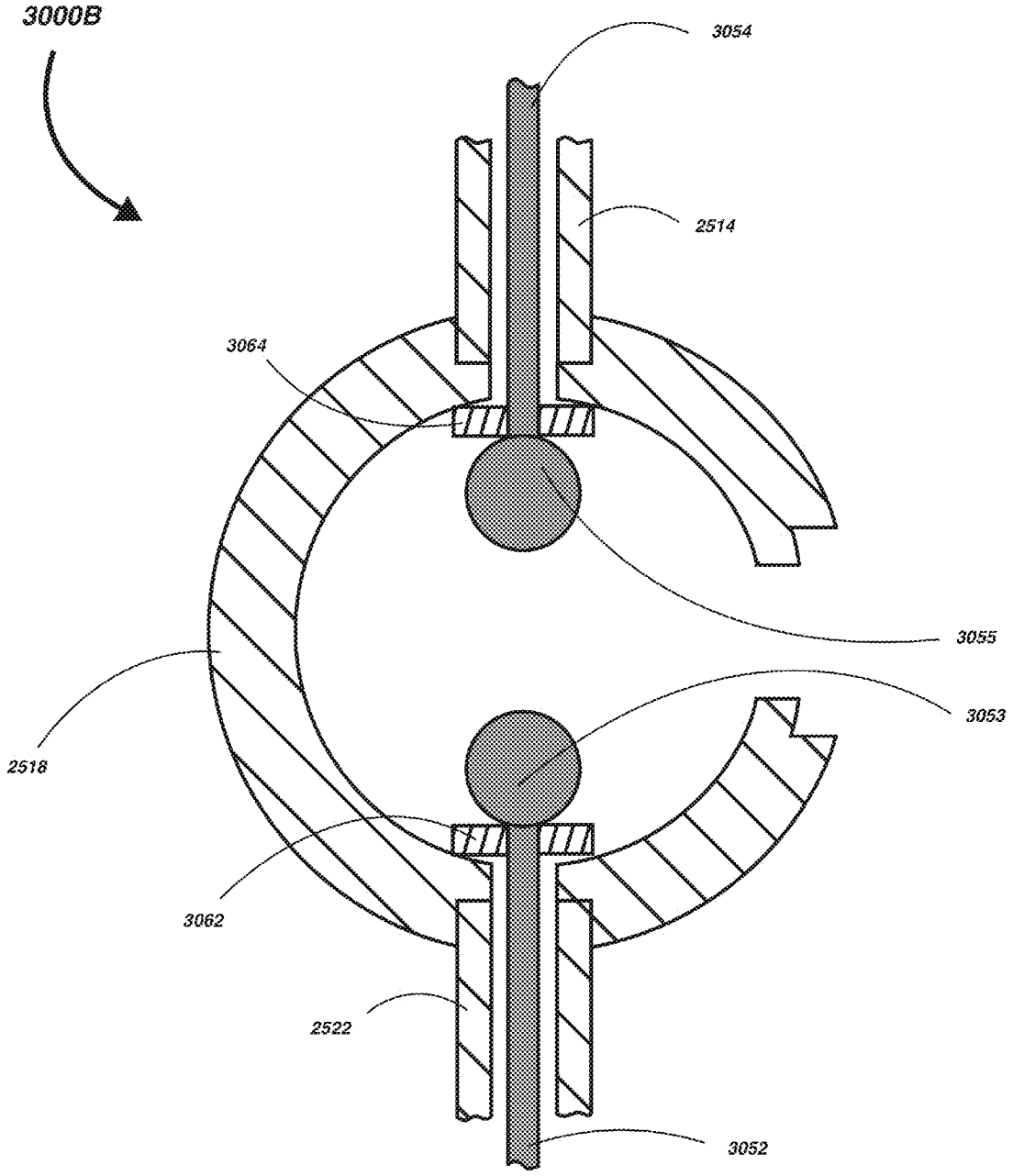

Similarly, as illustrated by the cross-sectional view of FIG. 30B, hub assembly 3000B includes elastic cords 3052, 3054, discs 3062, 3064 (with through holes), hollow bars 2522, 2514 and a joint 2518. In this embodiment, elastic cord 3054 is threaded through disc 3064 and terminated with a retaining knot 3055, while elastic cord 3052 is looped through ring 3062 and terminated with a retaining knot 3053, thereby enabling the respective hollow bars 2514, 2522 to be retained to joint 2518 in the assembled state until separated into the collapsed state.

Figure 31:
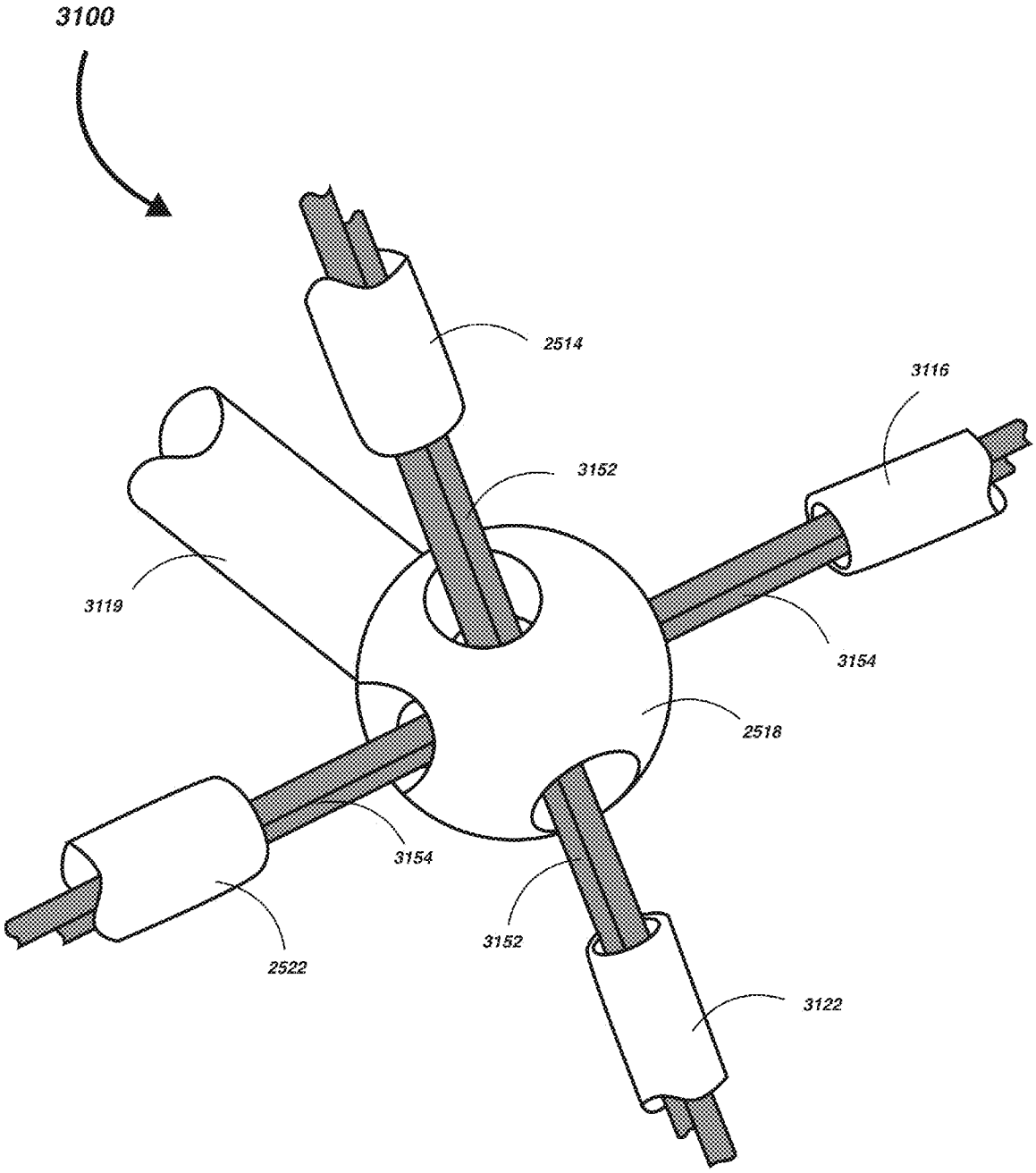

Referring now to the perspective view of FIG. 31, hub assembly 3100, includes two pairs of elastic cords 3152, 3154, hollow bars 2514, 3116, 2522, 3122, a cross member 3119 and a joint 2518. In this embodiment, pairs of hollow tubes, e.g., tubes 2514, 3122 and 2522, 3116 are configured to be retained to corresponding openings of joint 2518 by the elastic cord pairs 3152 and 3154, respectively.

Figure 32:
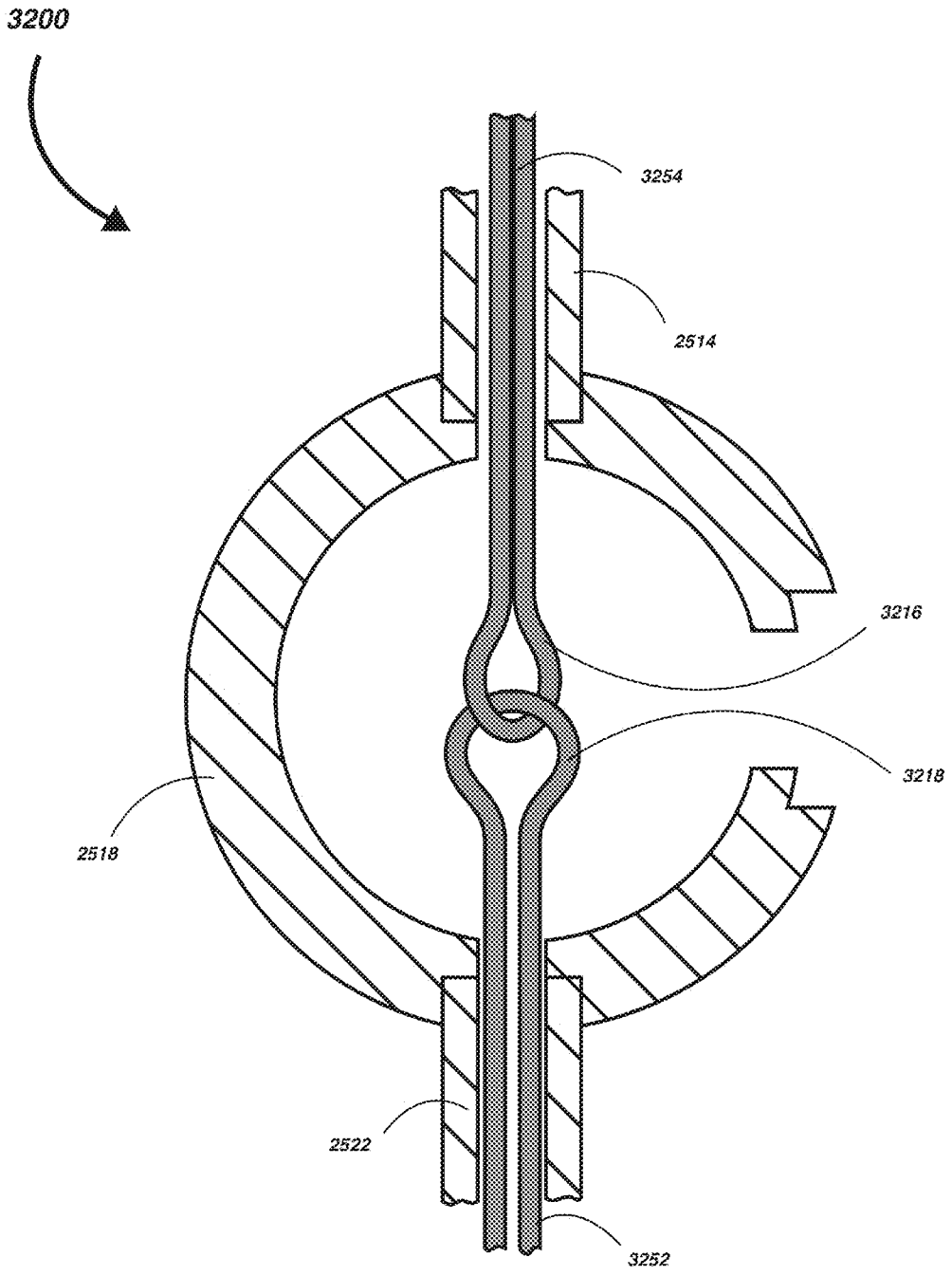
Figure 33:
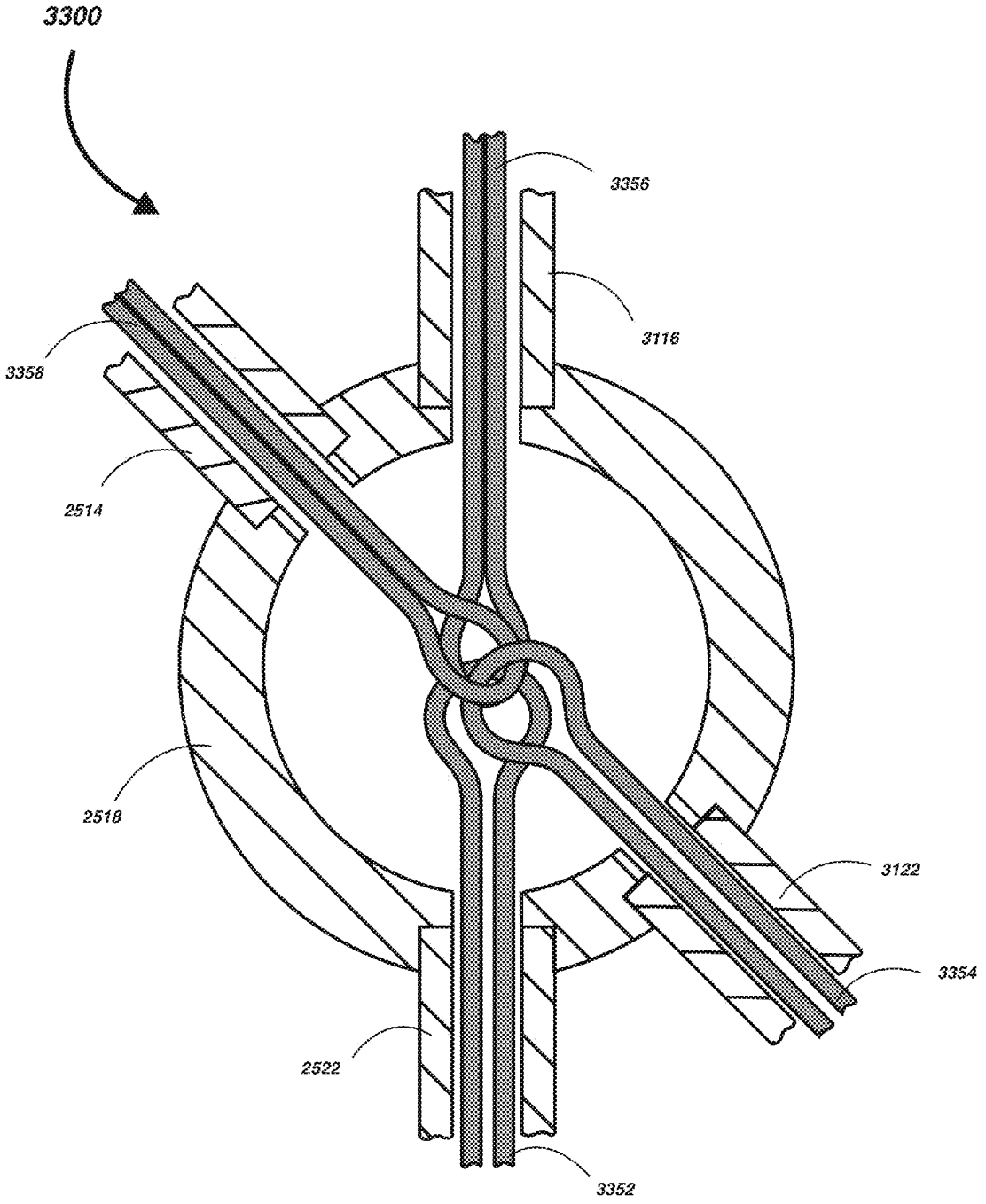
Figure 34A:
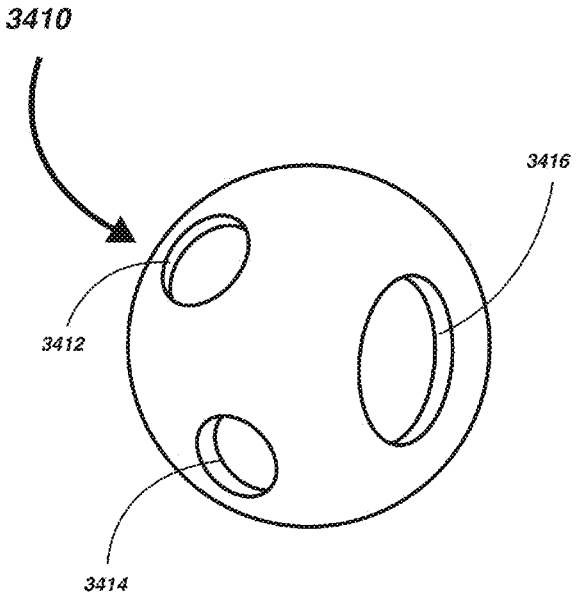
FIGS. 34A to 34D are perspective views of alternate embodiments of joints for the portable chair hub assemblies in accordance with the present invention.
Figure 34B:
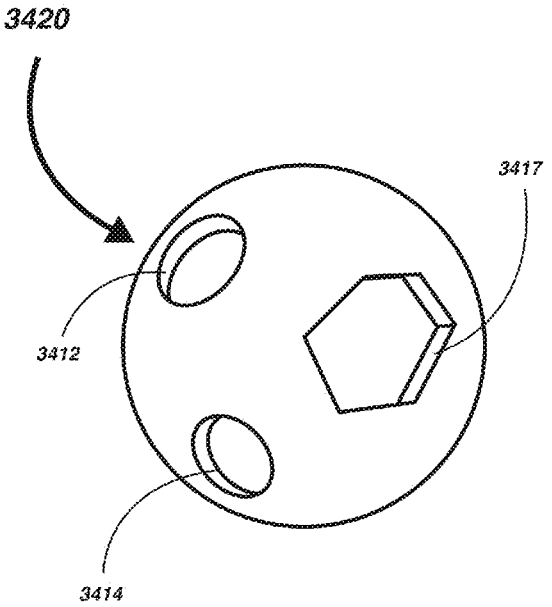
Figure 34C:
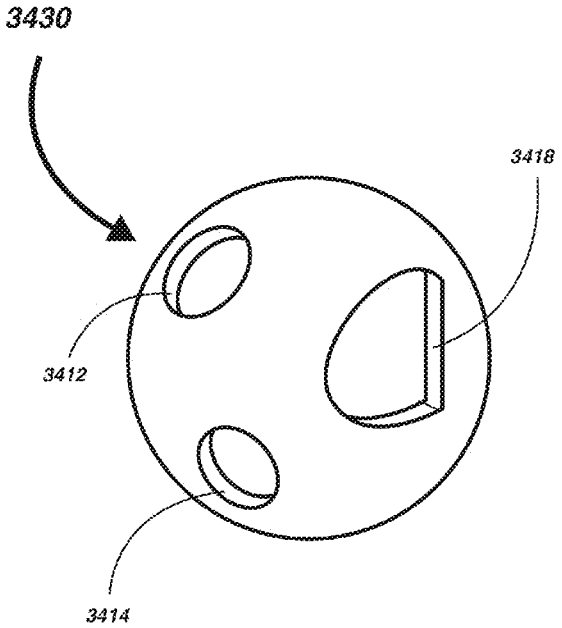
Figure 34D:
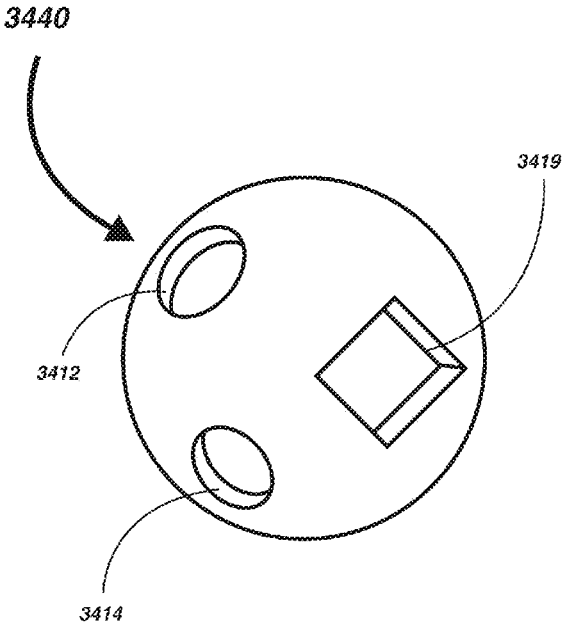

FIGS. 32 and 33 are cross-sectional views illustrating two additional exemplary embodiments of hub assemblies 3200 and 3300, wherein two or more elastic cords are looped to each other. For example, hub assembly 3200 includes two elastic cords 3254 and 3252 that are looped to each other, and configured to enable the hollow bars 2514, 2522 to be retained to joint 2518 in the assembled state until separated into the collapsed state. Similarly, hub assembly 3300 includes two pairs of elastic cords 3352, 3356 and 3254, 3358 that are looped to each other, and configured to enable the respective pairs of hollow bars 2522, 3116 and 3122, 2514 to be retained to joint 2518 in the assembled state until separated into the collapsed state.

FIGS. 34A, 34B, 34C and 34D are perspective views of exemplary joints for hub assemblies of the portable chairs described above. Joints 3410, 3420, 3430, and 3440 include openings 3412, 3414 configured to retain portable chair hollow tubes (not shown). Joints 3410, 3420, 3430 and 3440 also include non-circular recesses configured to retain a portable chair cross member (not shown), thereby enhancing stability by reducing twisting motions between the respective joint and cross member in the assembled state. Many non-circular recess profiles are possible, such as elliptical, polygonal (including quadrilaterals such as rectangular, rhombus, trapezoid), and triangular. Exemplary joints 3410, 3420, 3430 and 3440 include an oval recess 3416, a hexagonal recess 3417, a D-shaped recess 3418 and a square recess 3419, respectively.

Many modifications and additions to the above described hub assemblies are possible. For example, combinations of the above embodiments, such as a looped elastic cord combined with one knotted elastic cord, both elastic cords coupled to a ring. The present invention is also applicable to embodiments with a single elastic cord, or two or more elastic cords. In addition, knots can be formed using a variety of methods known to one skilled in the art, including gluing, welding, or ultrasonic bonding, and/or heat-based or chemical-based joinery methods. Other exemplary modifications include terminals formed using for example a disc with a through hole combined with an elastic with a knotted end configured to secured to the disc.

Referring back to the embodiment of portable chair 2300 as illustrated by FIGS. 23A-23C, chair frame 2310 can include a first detachable pair of collapsible bar sections 2314, 2324 a second detachable pair of collapsible bars 2316 and two joints 2318 each joint coupled to a corresponding detachable pair of bipod legs 2222. In addition, joints 2318 are coupled to each other via a detachable horizontal bar 2319.

Figure 35A:
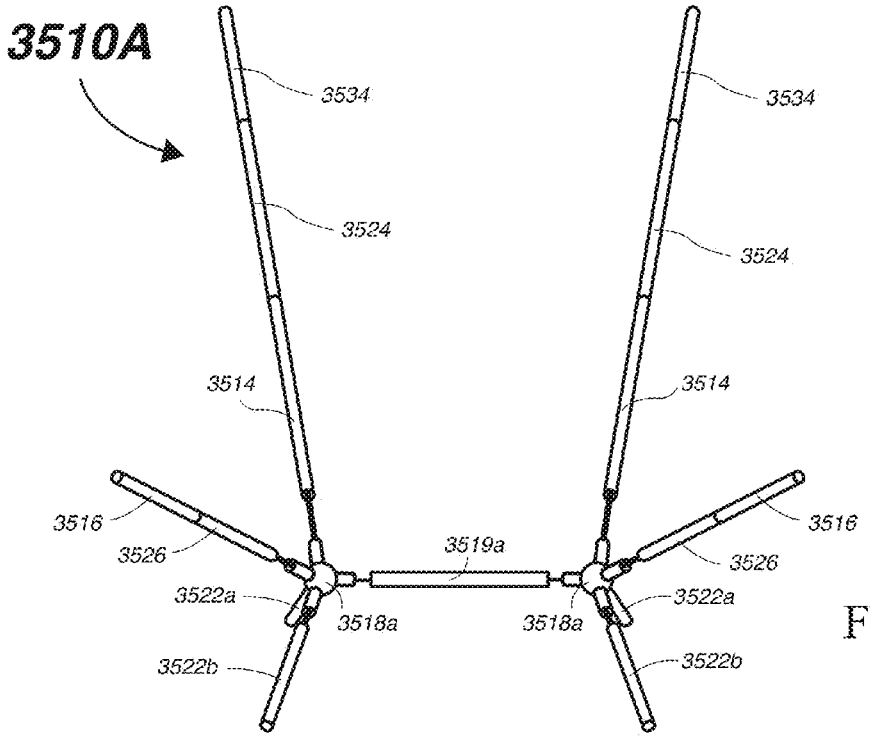

It is contemplated that chair frame 2310 can have several alternative detachable configurations, as illustrated by semi-disassembled views FIGS. 35A-35D showing chair frames 3510A, 3510B, 3510C and 3510D, respectively. For example, as shown in FIG. 35A, chair frame 3510A can include a detachable front pair of collapsible bar sections 3516-3526 and a detachable back pair of collapsible bar sections 3514-3534. In addition, chair frame 3510A can include a horizontal bar 3519*a* that is detachable from both joints 3518*a*. As discussed above, horizontal bar 3519*a* and joints 3518*a* can have corresponding mating non-circular profiles as exemplified by FIGS. 34A-34D. Chair frame 3510A can also include lower bars comprising of two fixed rear bipod legs 3522*a* permanently coupled to respective joints 3518*a*, and further comprising two front bipod legs 3522*b* that are detachable from respective joints 3518*a*.

Figure 35B:
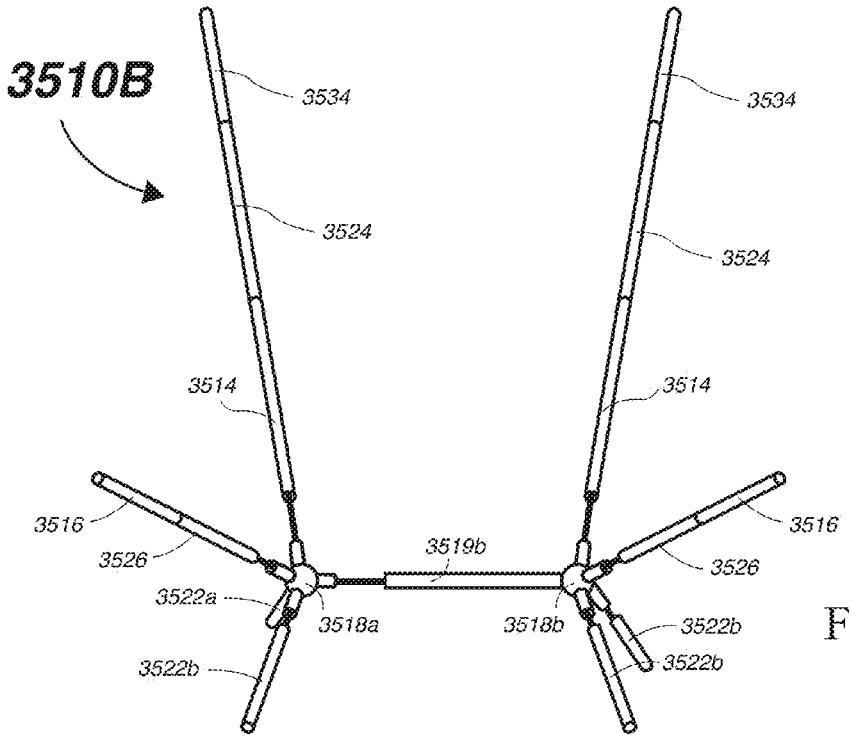

Alternatively, as shown in FIG. 35B, chair frame 3510B can include a horizontal bar 3519*b* having a first end that is fixed to joint 3518*b* and having a second end that is detachable from joint 3518*a*. Chair frame 3510B can also include a fixed rear bipod leg 3522*a* permanently coupled joint 3518*a*, and three bipod legs 3522*b* that are detachable from respective joints 3518*a*, 3518*b*.

Figure 35C:
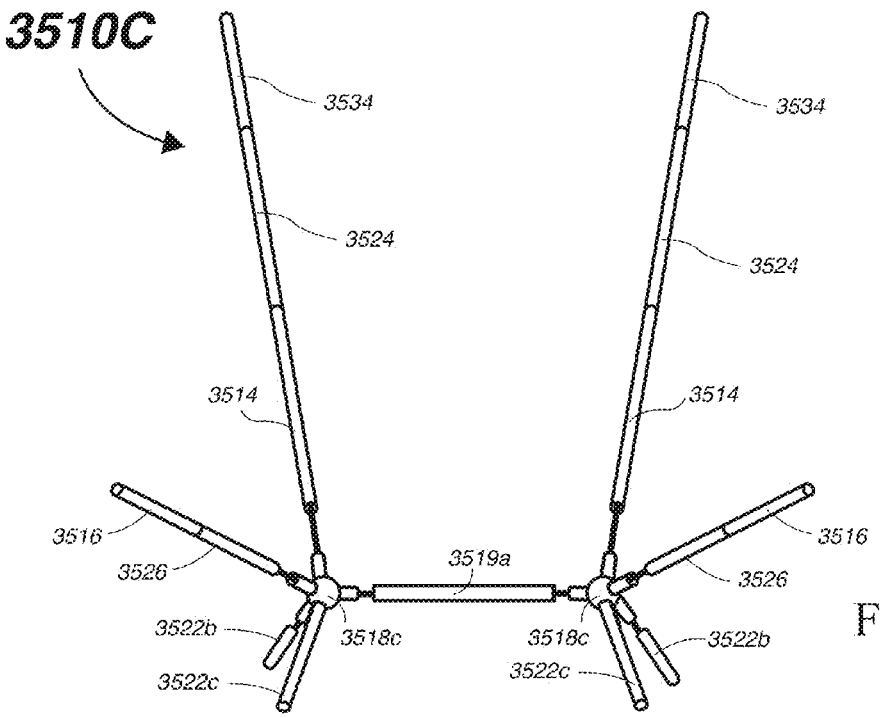

In another configuration as shown in FIG. 35C, chair frame 3510C can include a horizontal bar 3519*a* having ends that are detachable from both joints 3518*c*. Chair frame 3510C can also include two fixed front bipod legs 3522*c* permanently coupled respectively to joints 3518*c*, and two rear bipod legs 3522*b* that are detachable from respective joints 3518*c*.

Figure 35D:
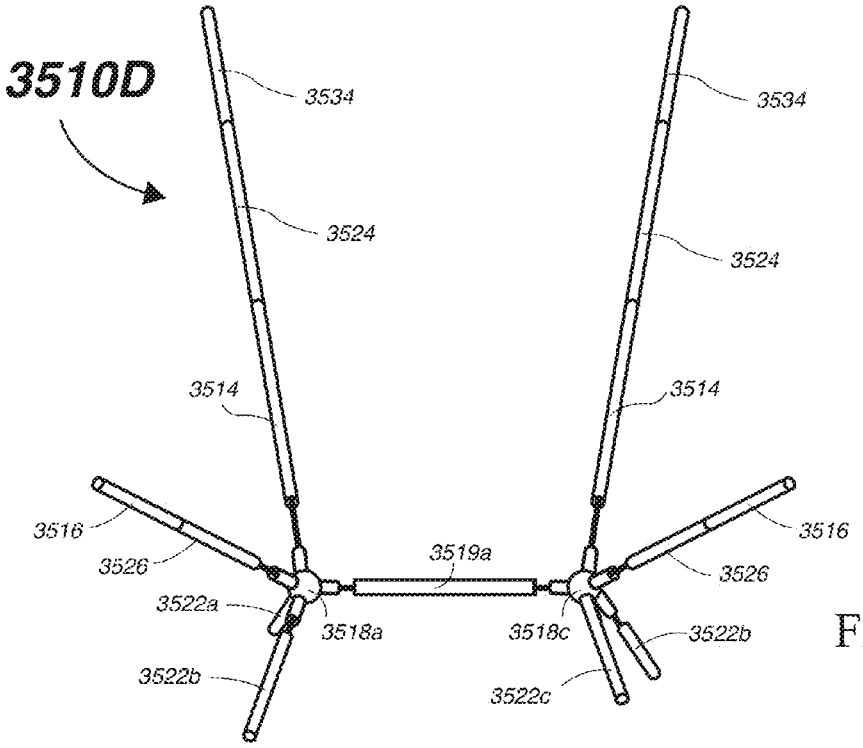

In yet another configuration as shown in FIG. 35D, chair frame 3510D can include a horizontal bar 3519*a* having ends that are detachable from both joints 3518*b*, 3518*c*. Chair frame 3510D can also include two fixed bipod legs 3522*a* permanently coupled respectively to joints 3518*a*, 3518*c*, and two bipod legs 3522*b* that are detachable from respective joints 3518*a*, 3518*c*.

Figure 35E:
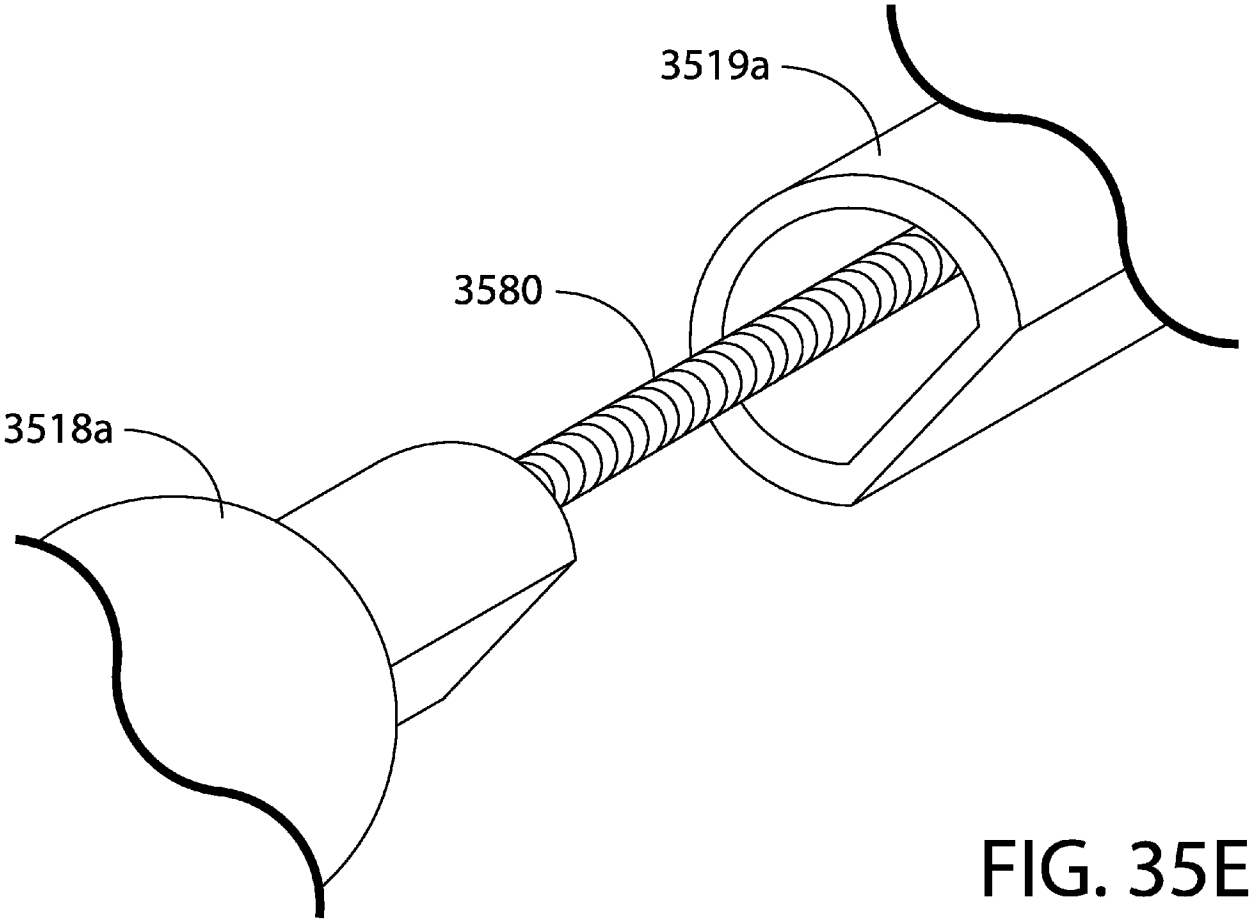
FIG. 35E is a perspective view of exemplary joint and horizontal bar for the chair frame of FIG. 35A, in accordance with the present invention.

Many other alternate chair frame configurations are also possible, as illustrated by the above four exemplary frames 3510A-3510D. Hence, chair frames may include one or more bars and/or legs that are permanently coupled to one or more chair frame joints. In addition, as illustrated by both FIG. 35A and FIG. 35E showing joint 3518*a*, elastic cord 3580 and horizontal bar 3519*a*, in some embodiments joints 3518*a* and bar 3519*a* can have corresponding male and female D-shaped cross-sectional profiles thereby enhancing stability.

While this invention has been described in terms of several embodiments, there are alterations, modifications, permutations, and substitute equivalents, which fall within the scope of this invention. Although sub-section titles have been provided to aid in the description of the invention, these titles are merely illustrative and are not intended to limit the scope of the present invention. It should also be noted that there are many alternative ways of implementing the methods and apparatuses of the present invention. It is therefore intended that the following appended claims be interpreted as including all such alterations, modifications, permutations, and substitute equivalents as fall within the true spirit and scope of the present invention.

What is claimed is:

1. A portable chair frame useful in association with a sling for accommodating a user in a seated position, the portable chair frame comprising:

a front pair of collapsible bars, each of the front pair of collapsible bars having a first end and a second end;

a back pair of collapsible bars, each of the back pair of collapsible bars having a first end and a second end;

a pair of joints, each of the pair of joints configured to be coupled to the corresponding first end of each of the front pair of collapsible bars and also to be coupled to the corresponding first end of the back pair of collapsible bars;

a center bar configured to securely couple the pair of joints to each other;

a first set of lower bars, at least one of the first set of lower bars has a first end permanently fixed to one of the joints, and wherein a second end of first lower bars is configured to provide a point of contact with a ground surface;

a second set of lower bars, at least one of the second set of lower bars has a first end configured to be detachably coupled to one of the joints, and wherein a second end of second lower bars is configured to provide a point of contact with a ground surface; and wherein the second end of each of the front pair of bars are configured to support corresponding front corners of a sling for accommodating a user in a seated position, and wherein the second end of each of the back pair of bars are configured to support corresponding back corners of the sling.

2. The portable chair frame of claim 1 wherein the front pair of joints are further configured to support corresponding front corners of a sling for accommodating a user in a seated position, and wherein the second end of each of the back pair of bars are configured to support corresponding back corners of the sling.

3. The portable chair frame of claim 1 further comprising an elastic cord configured to pass through at least one of the front pair of collapsible bars.

4. The portable chair frame of claim 1 wherein at least one of the back pair of collapsible bars comprises a first hollow bar and a second hollow bar, wherein the first hollow bar includes a first section of a first outer diameter and a second section of a second outer diameter less than the first diameter, and wherein the second section of the first hollow bar is configured to slide into a recess on one end of the second hollow bar, wherein the recess of the second hollow bar has an inner diameter slightly larger than the second outer diameter of the second section of the first hollow bar.

5. The portable chair frame of claim 1 wherein at least one end of the center bar has a non-circular cross-sectional profile.

6. The portable chair frame of claim 5 wherein the non-circular cross-sectional profile is substantially D-shaped.

7. A portable chair for accommodating a user in a seated position, the portable chair comprising:

a front pair of collapsible bars, each of the front pair of collapsible bars having a first end and a second end;

a back pair of collapsible bars, each of the back pair of collapsible bars having a first end and a second end;

a pair of joints, each of the pair of joints configured to be coupled to the corresponding first end of each of the front pair of collapsible bars and also to be coupled to the corresponding first end of the back pair of collapsible bars;

a center bar configured to securely couple the pair of joints to each other;

a first set of lower bars, at least one of the first set of lower bars has a first end permanently fixed to one of the joints, and wherein a second end of first lower bars is configured to provide a point of contact with a ground surface;

a second set of lower bars, at least one of the second set of lower bars has a first end configured to be detachably coupled to one of the joints, and wherein a second end of second lower bars is configured to provide a point of contact with a ground surface; and a sling for accommodating a user in a seated position, wherein the sling includes a pair of front frame interfaces configured to be coupled to the corresponding second end of each of the front pair of collapsible bars, and wherein the sling also includes a pair of back frame interfaces configured to be coupled to the corresponding second end of the back pair of collapsible bars.

8. The portable chair of claim 4 further comprising an elastic cord configured to pass through at least one of the back pair of collapsible bars.

9. The portable chair of claim 4 wherein at least one of the back pair of collapsible bars comprises a first hollow bar and a second hollow bar, wherein the first hollow bar includes a first section of a first outer diameter and a second section of a second outer diameter less than the first diameter, and wherein the second section of the first hollow bar is configured to slide into a recess on one end of the second hollow bar, wherein the recess of the second hollow bar has an inner diameter slightly larger than the second outer diameter of the second section of the first hollow bar.

10. The portable chair of claim 4 wherein at least one end of the center bar has a non-circular cross-sectional profile.

11. The portable chair of claim 10 wherein the non-circular cross-sectional profile is substantially D-shaped.

12. The portable chair of claim 4 wherein the sling includes a middle sling section and a pair of side sling sections, the middle sling section having a waist, and wherein the middle and side sling sections are configured to cooperatively form a seat pocket for a user.

* * * * *